US007740519B2

(12) United States Patent
Hatano et al.

(10) Patent No.: US 7,740,519 B2
(45) Date of Patent: Jun. 22, 2010

(54) METHOD FOR PROCESSING CHAMFERING OF EYEGLASS LENS AND APPARATUS FOR PROCESSING THE SAME

(75) Inventors: Yoshiyuki Hatano, Tokyo (JP); Kenichi Watanabe, Tokyo (JP); Takeshi Nakamura, Tokyo (JP); Takumi Uchiyama, Tokyo (JP); Yasuhiko Kusaka, Tokyo (JP)

(73) Assignee: Kabushiki Kaisha TOPCON, Tokyo (JP)

( * ) Notice: Subject to any disclaimer, the term of this patent is extended or adjusted under 35 U.S.C. 154(b) by 0 days.

(21) Appl. No.: 10/825,491

(22) Filed: Apr. 15, 2004

(65) Prior Publication Data

US 2004/0209547 A1 Oct. 21, 2004

(30) Foreign Application Priority Data

Apr. 16, 2003 (JP) ..... 2003-112127
Apr. 17, 2003 (JP) ..... 2003-113360
Apr. 17, 2003 (JP) ..... 2003-113389

(51) Int. Cl.
*B24B 49/00* (2006.01)

(52) U.S. Cl. ..... 451/5; 451/8; 451/43

(58) Field of Classification Search ..... 451/42, 451/43, 5, 8, 285–290
See application file for complete search history.

(56) References Cited

U.S. PATENT DOCUMENTS 5,485,399 A * 1/1996 Saigo et al. ..... 351/178
6,050,877 A * 4/2000 Shibata et al. ..... 451/5
6,059,635 A * 5/2000 Mizuno ..... 451/5
6,688,944 B2 * 2/2004 Hatano et al. ..... 451/5

FOREIGN PATENT DOCUMENTS

| | | |
|---|---|---|
| JP | 5-41386 | 6/1993 |
| JP | 7-186028 | 7/1995 |
| JP | 10-225853 | 8/1998 |
| JP | 10-225854 | 8/1998 |
| JP | 10-225855 | 8/1998 |
| JP | 2001-018154 | 1/2001 |
| JP | 2001-018155 | 1/2001 |
| JP | 2001-157957 | 6/2001 |
| JP | 2001-212741 | 8/2001 |
| JP | 2002-126983 | 5/2002 |
| JP | 2002-126985 | 5/2002 |

OTHER PUBLICATIONS

Japan Patent Office, First Office Action in JP 2003-113360, mailed Apr. 17, 2007, Japan Patent Office, Japan.

* cited by examiner

*Primary Examiner*—Maurina Rachuba
(74) *Attorney, Agent, or Firm*—Chapman and Cutler LLP

(57) ABSTRACT

A method for processing a chamfering of an eyeglass lens, including the steps of inputting a width of the chamfering and a range of the chamfering from a periphery of a lens shape at a position adjacent to a nose and/or a position far away form the nose, obtaining a trace of the chamfering on a refractive surface of the eyeglass lens and displaying the trace of the chamfering by overlapping the lens shape.

3 Claims, 21 Drawing Sheets

METHOD FOR PROCESSING CHAMFERING OF EYEGLASS LENS AND APPARATUS FOR PROCESSING THE SAME

BACKGROUND OF THE INVENTION

1. Field of the Invention

The present invention relates to a method for processing a chamfering of an eyeglass lens or eyeglass lenses and an apparatus for processing the same, which are adapted to carry out a chamfering-processing simulation by inputting a chamfering width and a chamfering range based on a periphery of a lens shape of an eyeglass frame, by computing a chamfering trail after the chamfering and an edge end after the chamfering, and by displaying them.

The present invention also relates to a method for processing a chamfering of an eyeglass lens or eyeglass lenses and an apparatus for processing the same, which are configured to chamfer an edge surface in such a manner that a proportion between a width of a front bottom portion and a width of a back bottom portion centered on a mountain of a V shape or a groove is gradually changed, in the edge surface of the eyeglass lens on which the V shape or the groove engaging with an eyeglass frame or wire frame such as Nylol (registered trade mark) is processed.

The present invention relates to a method for processing a chamfering of an eyeglass or eyeglass lenses and an apparatus for processing the same, which are configured to chamfer by changing a chamfering width so that a width of a front bottom portion, a width of a back bottom portion and the chamfering width of an edge surface become optimum sizes.

2. Description of Related Art

Conventionally, there are known a lens grinding apparatus in which a periphery of a circular unprocessed blank of an eyeglass lens or an unprocessed lens is ground based on lens shape information ($\theta i$ $\rho i$ ) in such a manner that the blank is formed into a lens shape of an eyeglass frame, a rimless frame and a wire frame such as NYLOL or the like, and an apparatus for processing a chamfering of an edge end of a peripheral edge of an eyeglass lens, after the blank is ground by the lens, grinding apparatus, as disclosed in Japanese Patent Laid-Open Nos. H 10-225853, H10-225854, H10-225855, 2001-18154, 2001-18155, 2002-126983 and 2002-126985.

Moreover, conventionally, in the chamfering processing of the edge of the eyeglass lens, because it is desired to chamfer the edge so that the edge thickness is approximately constant throughout the minimum width to a middle width, and the middle width to the maximum width, the processing for chamfering in which the edge has a constant width visibly has been carried out by changing a width of the chamfering processing at any radius vector position of the lens shape of the eyeglass lens, as disclosed in the aforementioned patent publications.

Because eyeglasses in which an edge thickness of the eyeglasses attached to a frame is not appealing, have been requested to a wearer of the eyeglasses, when viewing the wearer attaching the eyeglasses from front, an apparatus for chamfering the edge surface, so that a width of each edge surface of the right and left eyeglass lenses after processing sees constantly, is disclosed in Japanese Patent Laid-Open No. 2001-157957.

On the other hand, in the eyeglass lenses on which V shapes and grooves are processed, an apparatus for processing capable of changing at any radius vector position of a lens shape of an eyeglass frame, widths of front and back bottom portions centered on bottom widths of edge surfaces, namely, widths of the front and back bottom portions centered on mountains of the V shapes and the grooves is disclosed in Japanese Patent laid-Open Nos. 2001-212741 and H7-186028, and Japanese Examined Patent Publication No. H5-41386.

However, in the conventional chamfering processing apparatuses, as described above, although an ear side of the eyeglass frame, in other words, the chamfering of an edge end of eyeglass lens at a portion of the frame far way from a nose pad (hereinafter, referred to as ear side), is carried out controllably by changing a width of chamfering, the processing for chamfering accurately the edge end at the side of the nose pad of the eyeglass frame, namely, a portion in the vicinity of the nose pad (hereinafter, referred to as node side) cannot be carried out controllably.

Therefore, because an edge thickness of the edge end at the nose side of each of the chamfered eyeglass lenses remains thick, the wearer feels the eyeglasses heavily and cannot wear the eyeglasses comfortably. Moreover, there is a case that the edge surfaces of the lenses abut with fittings for holding the nose pad, a worker of the eyeglasses carries out addition operations to the eyeglasses by hands. There has also raised a demand that a now how of a technical chamfering processing technology which has been carried out by the worker is realized by a processing apparatus and a fine processing can be carried out. If the eyeglass lens on which the V shape and the groove are formed is chamfered, when the width of the back bottom portion is less than that of the front bottom portion centering on the mountain of the V shape and the groove, there is a problem in the appearance because the back bottom portion or back edge portion after the eyeglass lenses having the V shapes is inserted in the eyeglass frame is small and therefore, the lenses see to project forwardly of the eyeglass fame. In case of the wire frame, because a portion of the frame is composed of a metal or cell, the lenses see to project from the frame from a relative position between the eyeglass lenses and the frame, similarly as the V shape processing, and therefore there is a problem in the appearance.

In case of the eyeglass lenses on which the groove is formed, the width of the back bottom portion is short, when the eyeglass lenses are inserted in the wire frame such as Nilol (registered trade mark), there is a fear that strength for a wire becomes low.

Furthermore, in the chamfering processing apparatus, the V shape processing apparatus and the groove processing apparatus, in the prior art as described above, because the bottom widths of the chamfered edge surfaces; in other words, the widths of the front and back bottom portions centered on the mountain of the V shape, the widths of the front and back bottom portions centered on the groove are not processed into balanced optimum sizes, in the processed eyeglass lenses on which the V shapes and groove are formed, in the eyeglasses that processed lenses are inserted in the eyeglass frame, the edge thickness throughout the entire periphery of each of the eyeglass lenses is appealing, a good appearance cannot be expected, and the strength for supporting the wire frame such as the Nylol (registered trade mark) is not sufficient.

SUMMARY OF THE INVENTION

It is, therefore, an object of the present invention to provide a method and an apparatus for processing a chamfering of an eyeglass lens in which a processing for chamfering an edge end of the eyeglass lens at an eye side adjacent a temple and a nose side adjacent a nose pad can be realized controllably or the processing is displayed, and therefore it is possible to provide eyeglasses in which a wearer is easy to wear and difficult to tire when wearing, and an worker is not required to add any additional operation to the processed lenses.

To attain the above object, a method for processing a chamfering of an eyeglass lens, according to an aspect of the present invention, comprises steps of inputting a width of the chamfering and a range of the chamfering from a periphery of a lens shape at a position adjacent to a nose and/or a position far away form the nose, obtaining a trace of the chamfering on a refractive surface of the eyeglass lens and displaying the trace of the chamfering by overlapping the lens shape, and carrying out the processing of the chamfering of the eyeglass lens along the trace of the chamfering.

An apparatus for processing a chamfering of an eyeglass lens, according to another aspect of the present invention, comprises means for inputting a width of a chamfering and a range of the chamfering from a periphery of a lens shape at positions adjacent to a nose and/or far away form the nose, arithmetic control means for obtaining a trace for the chamfering on a refractive surface of the eyeglass lens and obtaining a position of an edge end of the eyeglass lens after the processing of the chamfering, and means for displaying the trace for the chamfering by overlapping the lens shape.

BRIEF DESCRIPTION OF THE DRAWINGS

FIG. 3 is a view showing the lens grinding apparatus, in which

DETAILED DESCRIPTION OF THE PREFERRED EMBODIMENTS

Several embodiments of the present invention will be explained with reference to the accompanying drawings below.

Figure 1:
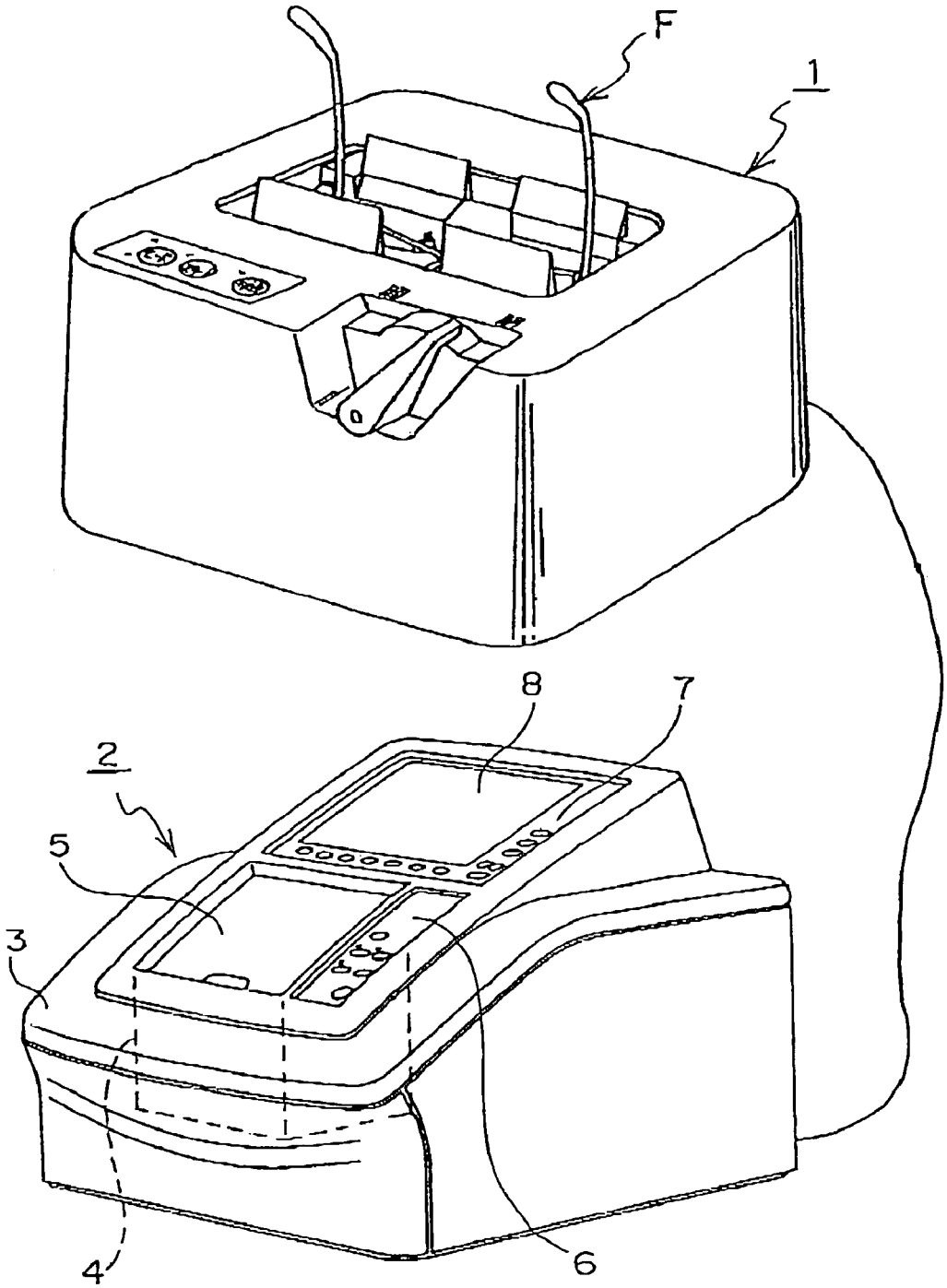
FIG. 1 is an explanatory view showing a relationship between a lens grinding apparatus including a layout-displaying device and a frame shape measuring apparatus, according to one embodiment of the present invention.

In FIG. 1, reference numeral 1 denotes an apparatus for measuring a frame shape or an apparatus for measuring a lens shape, which is readable lens shape information (θi ρi) of lens shape data based on a lens frame shape of an eyeglass frame F, a template of the frame or a template model or the like, reference numeral 2 a lens grinding processing apparatus or lens grinding machine for grinding an eyeglass lens or eyeglass lenses based on the lens shape data of the eyeglass frame inputted through transmission from the apparatus for measuring the frame shape. Meanwhile, because any well-known apparatus can be used for the apparatus 1 for measuring the frame shape, a description of a detailed structure thereof and measuring data and so on is omitted.

<Lens Grinding Apparatus 2>

Figure 2:
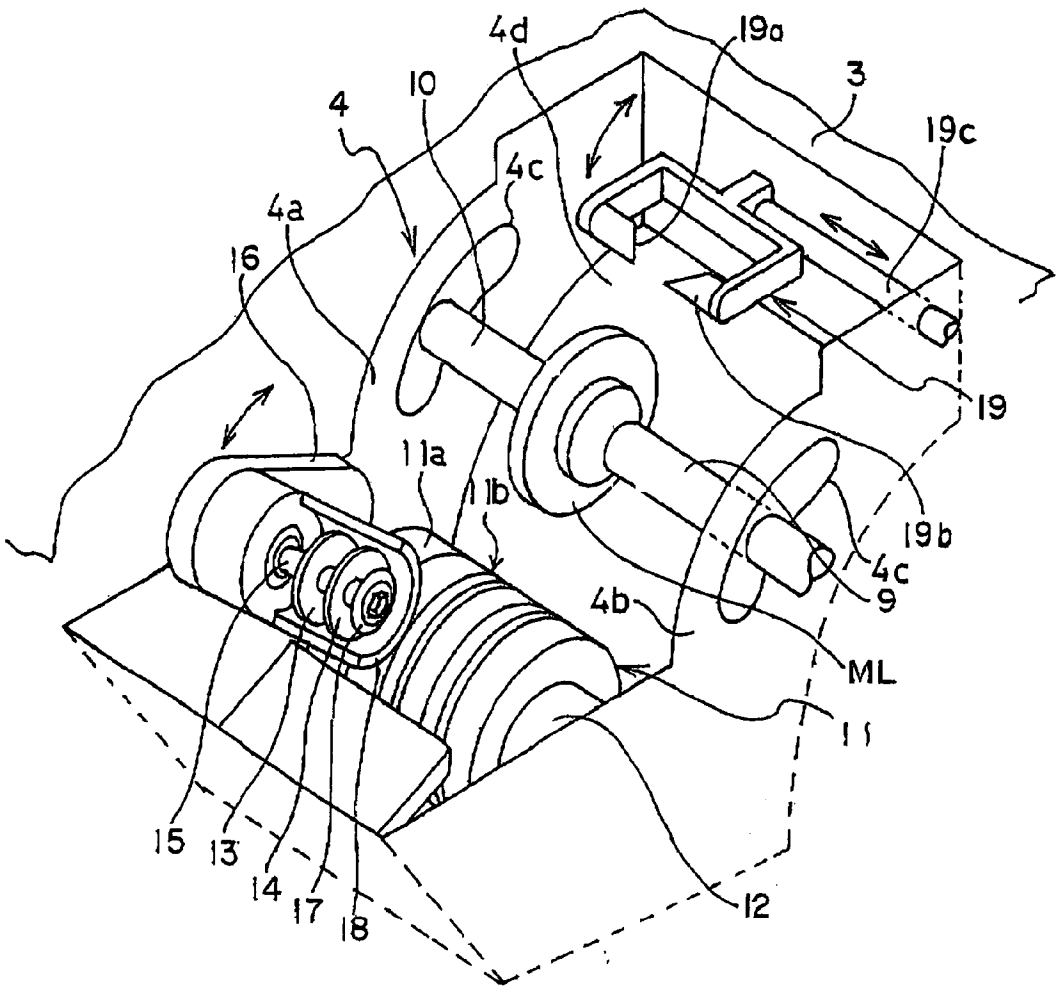
FIG. 2 is a perspective view showing a main processing part in the lens grinding apparatus.

The lens grinding apparatus 2 comprises a processing room 4 disposed in the vicinity of a front surface of an apparatus body 3 and a cover 5 for opening and closing an opening of the processing room 4, as shown in FIG. 1. Main parts for processing are disposed in the processing room 4, as shown in FIG. 2. A carriage (not shown) for holding a portion of the main parts and a driving system, for example, a motor or the like for the carnage are disposed outside the processing room 4. The carriage is composed of a pair of right and left arm portions extending forwardly and backwardly and a connecting portion for connecting back end portions of the arm portions and is formed into U-character shape as viewed in plane. The carriage is movable rightward and leftward, and the arm portions are provided movably upwardly and downwardly about the back end portions of the connecting portion.

In addition, in FIG. 2, reference numerals 4*a* and 4*b* denote sidewalls of the processing room 4, and reference numerals 4*c* and 4*c* circulate arc slits provided in the sidewalls 4*a* and 4*b*. The pair of arm portions of the carriage is disposed outside of the sidewalls 4*a* and 4*b*. Because the carriage having the arm portions is well known, a detailed description thereof and drawings are omitted.

The lens grinding apparatus 2 includes first and second operational panels 6 and 7 used in performing a control operation of the driving system and a data setting operation and a liquid crystal indicator 8 as a display device or display means for displaying a state of operation and so on by the operational panels 6 and 7.

(Main Parts for Processing)

There are provided a pair of right and left shafts 9 and 10 for rotating a lens, which extend rightward and leftward of the apparatus body 3 and passing through the slits 4*c* and 4*c*, as the main parts for processing disposed in the aforementioned processing room 4, as shown in FIG. 2. Meanwhile, the slits 4*c* and 4*c* are closed by a cover (not shown) for moving with the lens-rotating shafts 9 and 10.

The lens rotating shafts 9 and 10 are disposed mutually in line to have the same axes and held movably on the pair of arm portions of the carriage, respectively. The lens-rotating shaft 10 is provided to approach to and come away from the lens-rotating shaft 9.

An eyeglass lens ML can be held between the lens-rotating shafts 9 and 10 by positioning the eyeglass lens between the lens-rotating shafts 9 and 10 and then by moving to approach the lens rotating shaft 10 to the lens rotating shaft 9. By the reversed operation to his, the eyeglass lens ML can be removed from the lens-rotating shafts 9 and 10.

As the main parts for processing, there are provided a grinding wheel 11 for grinding the eyeglass ML, a shaft 12 on which the grinding wheel 11 is mounted to rotate the grinding wheel, chamfering grinding wheels 13 and 14 for processing a chamfering on a peripheral edge portion of the eyeglass lens ML, and a groove forming cutter or grinding wheel 17 for processing a groove on an edge surface of the eyeglass lens ML.

Moreover, as the main parts for processing, there are provided a chamfering shaft 15 for supporting the chamfering grinding wheels 13 and 14 and the groove processing cutter 17 to rotate them, a swinging am 16 for swinging the chamfering shaft 15, and a circular arc cover 18 for covering lower portions of the chamfering grinding wheels 13 and 14 and the groove processing cutter 17. The groove processing cutter 17 is disposed on the chamfer shaft 15 adjacent the chamfering grinding wheel 14.

There are provided a horse (not shown) provided inside the arc cover 18 and configured to supply a grinding liquid on grinding surfaces of the grinding wheel 11, the chamfering grinding wheels 13 and 14 and the groove processing cutter 17, and a measuring member 19 for measuring a thickness Wi of an edge of the eyeglass lens ML.

The cover 5 is composed of one panel of glass or resin of non-colored or colored transparence, for example, half-transparent blue and is slidable forwardly and backwardly of the apparatus body 3.

In addition, the processing room includes a rounded inclined surface 4*d* positioned backwardly of the eyeglass lens ML to facilitate grinded waste to flow.

(Driving System for the Main Parts for Processing)

The driving system includes the above carriage (not shown), up and down moving means (not shown) for moving upward and downward the carriage by use of a drive motor such as a pulse motor or the like, a drive motor (not shown) such as a pulse motor or the like for moving rightward and leftward the carriage, a drive motor (not shown) such as a pulse motor for driving the lens-rotating shafts 9 and 10, a drive motor (not shown) for rotating the grinding wheel 11 when grinding the eyeglass lens ML held between the lens rotating shafts 9 and 10 in response to the up and down movements and rotation of the carriage, and so on.

Because such drive motors and so on for driving the carriage are well known, a detailed description is omitted. Meanwhile, the grinding wheel 11 includes a rough-grinding wheel, a grinding wheel for forming a V-shaped groove, a finishing grinding wheel and so on.

The aforementioned driving system rotates the lens-rotating shafts 9 and 10 every an angle θi (i=0, 1, 2, 3, . . . ,n) based on the lens shape information (θi ρi) by means of the not-shown drive motor and moves upwardly and downwardly the carriage (not shown) by means of the not-shown drive motor to grind a peripheral edge of the eyeglass lens ML by means of the rough grinding wheel a of the rotating grinding wheel 11. At the time, the driving system moves upwardly and downwardly a front end of the carriage every the angle θi, in such a manner that a center distance between the lens rotating shafts 9, 10 and the shaft 12 of the grinding wheel 11 becomes a value of a radius of the grinding wheel plus (+) radius vector ρi every the angle θi, to thus move upwardly and downwardly the lens-rotating shafts 9, 10 and the eyeglass lens ML. Therefore, the eyeglass lens ML is ground roughly based on the lens shape, information (θi ρi )by the grinding wheel 11.

The driving system also controls the drive motors based on the lens shape information (θi ρi), similarly as the above, so that a process of the V-shaped groove can be carried out on an end surface of the edge of the eyeglass lens ML which is roughly ground as shown in each of lens shapes LL, LR (see FIG. 6), by the grinding wheel 11*b* for forming the V-shaped groove. At this time, the driving system is configured to execute the process of the V shaped groove on the end surface of the edge of the eyeglass lens ML roughly ground into the lens shape based on predetermined data for a position of V shaped groove by controlling the drive motor fur driving rightward and leftward the carriage. In addition, because the process for grinding the eyeglass lens ML is well known, a detailed description is omitted.

(Measuring Member for Measuring the Edge Thickness)

The measuring member 19 includes a pair of opposite feelers 19*a* and 19*b* spaced apart with respect to each other. The feelers 19*a* and 19*b* are attached integrally on a measuring shaft 19*c* extending rightward and leftward. On end of the measuring shaft 19*c* passes through the sidewall 4*b* of the processing room 4 and is movable rightward and leftward. The measuring shaft 19*c* is also held by a spring (not shown) in such a manner that the feelers 19*a* and 19*b* are positioned approximately at a central portion of a back edge portion of the processing room 4 Accordingly, the feelers 19*a*, 19*b* and the measuring shaft 19*c* are returned approximately to the central portion of the back edge portion of the processing room 4, if a force for moving rightward and leftward them is removed.

Moreover, provided outside the processing room 4 is a measuring part (not shown) for detecting and measuring a position or an amount of movement of the feelers 19*a* and 19*b* in rightward and leftward directions, in association with the measuring shaft 19*c*. More specifically, the position or amount of movement of the feelers 19*a*, 19*b* and measuring shaft 19*c* in the rightward and leftward directions can be read by a reading sensor (positional detecting means or means for detecting the moved amount) which is not shown and is housed in the measuring part.

The measuring shaft 19*c* is also provided rotatably about an axis thereof by a drive means such as a pulse motor (not shown). The drive means rotates the measuring shaft 19*c* and rotates the feelers 19*a* and 19*b* between a position raised about 90 degrees or standby condition and a used position or used condition, fallen horizontally forwardly. The rotation is carried out by a control circuit, which will be explained below.

Meanwhile, the eyeglass lens ML is held between the lens-rotating shafts 9 and 10 and the feelers 19*a* and 19*b* are laid in a forwardly horizontally fallen condition when measuring the edge thickness Wi of the eyeglass lens ML based on the lens shape information (θi, ρi).

In the condition, a leading end of the feeler 19*a* can be abutted with an anterior refract surface of the eyeglass lens ML and a leading end of the feeler 19*b* can be abutted with a posterior refracting surface of the eyeglass lens ML by moving up and down, and right and left the lens-rotating shafts 9 and 10 integrally with the carriage by the drive motors.

Furthermore, the lens rotating shafts 9 and 10 are rotated every the angle θi based on the lens shape information (θi, ρi)

while abutting the leading end of the feeler 19*a* with the anterior refracting surface of the eyeglass lens ML, and the leading end of the feeler 19*a* can be contacted at and moved along a position of the radius vector ρi on the anterior refracting surface of the eyeglass lens ML by moving upward and downward in such a manner that the center distance between the lens rotating shafts 9, 10 and the grinding wheel 11 or shaft 12 of the grinding wheel becomes a value, Xi of "a radius of the grinding wheel 11 plus (+) radius vector ρi" every the angle θi. Similarly, the lens rotating shafts 9 and 10 are rotated every the angle θi based on the lens shape information (θi ρi ) while abutting the leading end of the feeler 19*b* with the posterior refracting surface of the eyeglass lens ML, and the leading end of the feeler 19*a* can be contacted at and moved along a position of the radius vector ρi on the posterior refracting surface of the eyeglass lens ML by moving upward and downward in such a manner that the center distance between the lens rotating shafts 9, 10 and the grinding wheel 11 or shaft 12 of the grinding wheel becomes the value, Xi of "a radius of the grinding wheel 11 plus (+) radius vector ρi" every the angle θi.

In this way, as the lens rotating shafts 9 and 10 are rotated based on the lens shape information (θi ρi) while contact the feelers 19*a* and 19*b* with the eyeglass lens ML, the feelers 19*a* and 19*b* can be moved rightward and leftward along curved surfaces of the refracting surfaces of the eyeglass lens ML, respectively.

Consequently, it is sufficient to be obtained by a reading sensor (not shown) in the measuring part, the rightward and leftward moved amounts or rightward and leftward moved amounts of the feeler 19*a* of the anterior refracting surface of the eyeglass lens ML in the lens shape information (θi ρi), using of the feeler 19*a*, in order to acquire the edge thickness Wi of the eyeglass lens ML. Here, an optical axial direction means an axial direction of the lens rotating shafts 9 and 10.

Subsequently, the rightward and leftward moved amounts or rightward and leftward moved amounts of the feeler 19*b* of the posterior refracting surface of the eyeglass lens ML in the lens shape information (θi ρi) are acquired by the reading sensor in the measuring part, using of the feeler 19*b*.

Here, it is assumed that a distance from a central position between the feelers 19*a* and 19*b* to the leading end of the feeler 19*a* when the feelers 19*a* and 19*b* are in original positions is xa, a distance from the central position between the feelers 19*a* and 19*b* to the leading end of the feeler 19*b* is −xa, amounts of movement in rightward and leftward directions of the feeler 19*a* from the original position are fa and −fa, and amounts of movement in rightward and leftward directions of the feeler 19*b* from the original position are fb and −fb. In these conditions, a position Fa of movement in rightward and leftward directions of the leading end of the feeler 19*a* from the central position between the feelers 19*a* and 19*b* becomes xa+fa or xa−fa, and a position Fb of movement in rightward and leftward directions of the leading end of the feeler 19*b* from the central position between the feelers 19*a* and 19*b* becomes −xa+fa, or −xa−fb.

Consequently, the moved amount fa of the feeler 19*a* is obtained as a moved position Fa' in the rightward and leftward directions of the feeler 19*a* from the central position between the feelers 19*a* and 19*b*, by subtracting the xa from the moved position Fa, and the moved amount fb of the feeler 19*b* is obtained as a moved position Fb' in the rightward and leftward directions of the feeler 19*b* from the central position between the feelers 19*a* and 19*b*, by subtracting the xa from the moved position Fb. As a result, it is possible to acquire the edge thickness Wi in c of the eyeglass lens ML by acquiring a difference of the obtained moved positions Fa' and Fb'.

(Operational Panel 6)

Figure 3A:
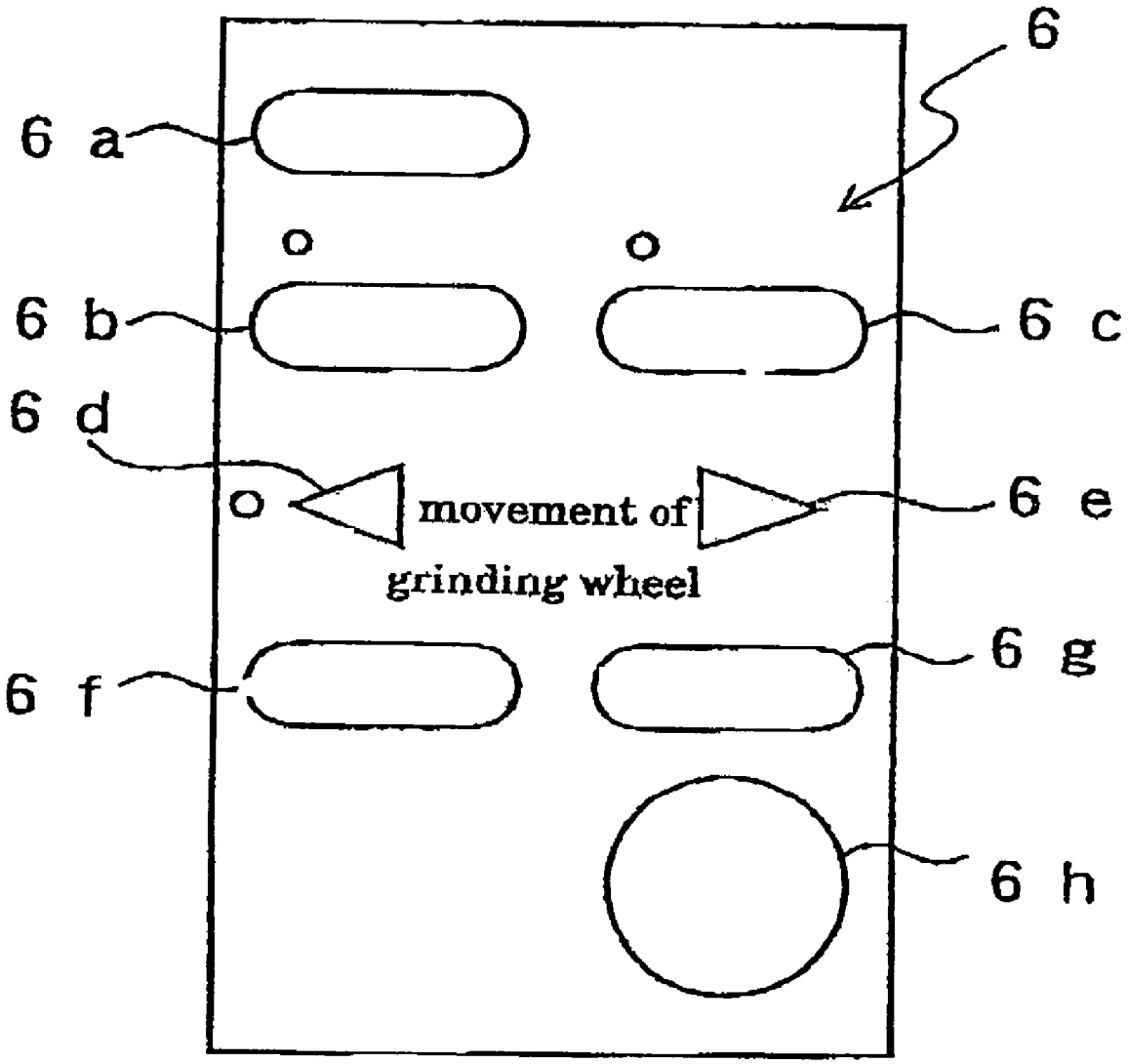
FIG. 3A is an enlarged explanatory view of a first operational panel and FIG. 3B is a front view of a liquid crystal indicator.

As shown in FIG. 3A, the operational panel 6 comprises a clamp switch 6*a* for operating the clamp of the eyeglass lens by the lens rotating shafts 9 and 10, right and left switches 6*b* and 6*c* for carrying out appointment of process of eyeglass lenses for right and left eyes and switch of display and so on, switches 6*d* and 6*e* for operating the movement of the grinding wheel in the right and left directions, a switch 6*f* for operating re-finishing and trial grinding of the eyeglass lens, when the finished processing of the eyeglass lens is insufficient and the trial grinding thereof is required a switch 6*g* for a rotational mode of the eyeglass lens, and a stop switch 6*h* for a stop mode of the eyeglass lens.

(Operational Panel 7)

Figure 3B:
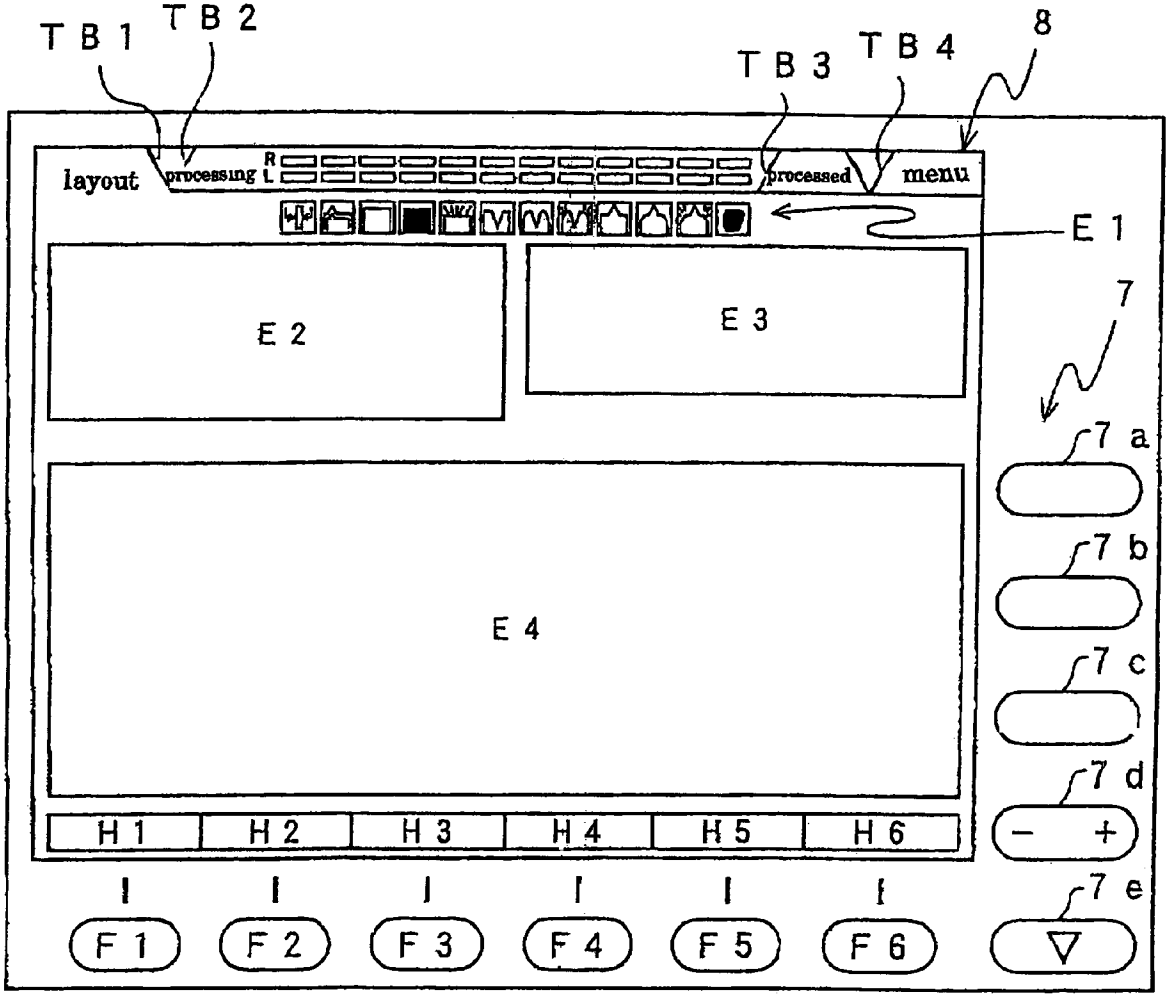

As shown in FIG. 3B, the operational panel 7 is disposed on a side portion of a liquid crystal indicator 8. The operational panel 7 comprises a screen switch 7*a* for switching a displaying state of the liquid crystal indicator 8, a memory switch 7*b* for storing settings regarding processing displayed on the liquid crystal indicator 8, a data demanding switch 7*c* for inputting the lens shape information (θi ρi) a see-saw type switch 7*d* for operating numeric correction as shown in minus (−) or plus (+) (a minus switch and a plus switch may be separately provided) or the like, and a switch 7*e* for moving a cursor type pointer as shown in a sign ∇. In addition, functional keys F1 to F6 are arranged a lower portion of the liquid crystal indicator 8.

The functional keys F1 to F6 are used when setting the processing of the eyeglass lens, else are used for response and selection with respect to a message displayed on the liquid crystal indicator 8 in a process for working.

(Liquid Crystal Indicator 8)

A tab TB1 for "lay out", a tab TB2 for "processing", a tab TB3 for "processed", and a tab TB4 for "menu" are represented on an upper portion of the liquid crystal indicator 8. The display of the liquid crystal indicator 8 can be switched by selection of the tabs TB1 to TB4.

Functional displaying parts H1 to H6 corresponding to the functional keys F1 to F6 are provided on a lower edge portion of the liquid crystal indicator 8. One or more parts according to need in the functional displaying parts H1 to H6 are displayed suitably. Moreover, when the functional displaying parts are in non-displaying conditions, figures, numeric values and conditions or the like, different from ones corresponding to the functions of the functional keys F1 to F6 can be displayed on the lower edge portion of the liquid crystal indicator 8.

When the "lay out" tab TB1, the "processing" tab TB2 and the "processed" tab TB3 are selected, they are displayed separately in an icon displaying area E1, a message displaying area E2, a numeric value displaying area E3 and a state displaying area E4. When the "menu" tab TB4 is selected, it may be displayed as one menu displaying area generally and as an independent sectional displaying area.

Icons displayed on the icon displaying area E1 are arranged corresponding to operations in conditions of measuring the shape of the edge thickness of the eyeglass lens based on the lens shape information (θi ρi) which is the lens shape data, of simulating the V-shape formed on the edge end of the eyeglass lens, of processing roughly the edge end, of finish processing the edge end, of mirror processing it, of processing the groove in the edge end, of forming the groove in the edge end and chamfering it, of forming the groove in the edge end, chamfering the edge end and mirror processing it, of processing the edge end into the V shape, of processing the edge end into the V shape and chamfering it, and processing the edge end into the V shape, chamfering the edge end and mirror processing it, and the termination of the grinding process of the eyeglass lens.

Provided on an upper portion of each icon are a plurality of cursor indicators which are disposed to enable an operator to identify the status of a series of works, with one-on-one correspondence and configured to light and display pursuant to the status of the series of works. The plurality of cursor indicators have portions for displaying the status of the right and left eye lenses, which are provided on the "processing" tab TB2 to be arranged in upper and lower two steps.

Various error, warning messages and so on are displayed on the message displaying area E2, depending on a state. In addition, if there is a risk of break or the like of parts and so on in the apparatus and the lens to be processed and there is the warning message, the message may be displayed by superposing on the message displaying area E2 and on an area other than the message displaying area E2 so that the operator can know easily the message.

A geometric distance, FPD value between centers of right and left lens frames of an eyeglass frame, a distance, PD value between pupils of the eyes of the wearer of the eyeglasses, a vertical component, UP value or Hlp value of a corrected amount which is a difference between the FPD and PD values, items of arrangement for a size of processing, and so on are displayed on the numeric value displaying area E3 at the time of inputting the lay out data. Moreover, at the time of an initial setting, a suction center of the processed lens is displayed other than the FPD, PD, UP, and size as described above. Furthermore, when inputting motor data, numeric values of size relationship regarding secondary processing of the chamfering of the eyeglass lens are displayed.

An image of the lay out of the eyeglass lenses for the right and left eyes, the V shape formed on peripheral edges of the maximum, minimum and middle or optional, other than the maximum and minimum on the eyeglass lenses, a shape of a side surface of the lens as viewed from the side surface of the peripheral edge, and a schematic view adapted to an actual processing state and so on are displayed.

(Functional Keys)

The functional keys F1 to F6 are used at the time of setting the items regarding the processing of the eyeglass lenses or used for the response and selection to the message displayed on the liquid crystal indicator 8 in the processing step.

The functional keys F1 to F6 are used as follows when setting the processing (lay out screen). That is to say, the functional keys 1, 2, 3, 4, 5, and 6 are used for inputting a lens type, for inputting a lens blank, for inputting a kind of frame, for inputting a kind of chamfering, for inputting a mirror processing, and for inputting a processing course, respectively.

There are "monofocus", "ophthalmic prescription", "progress", "bi-focuses", "cataract" "tsubokuri", "8 curves" and so on, as the lens types inputted by the functional key F1. In addition, the "cataract" means a plus lens having a large refractive degree usually in the eyeglass industry, the "tsubokuri" means a minus lens having a large refractive degree, and the "8 curves" means a lens refractive surface having eight curves.

There are "plastic resin" (hereinafter, referred to as "pla"), "high index", "glass", "polycarbonate" (hereinafter referred to as "polyca"), "acryl" and so on, as the blanks of the processed lens inputted by the functional key F2.

There are "metal", "cell", "optil", "flat", "groove forming (thin)", "groove forming (middle)", "groove forming (thick)" as the kinds of the eyeglass frame inputted by the functional key F3.

Figure 9:
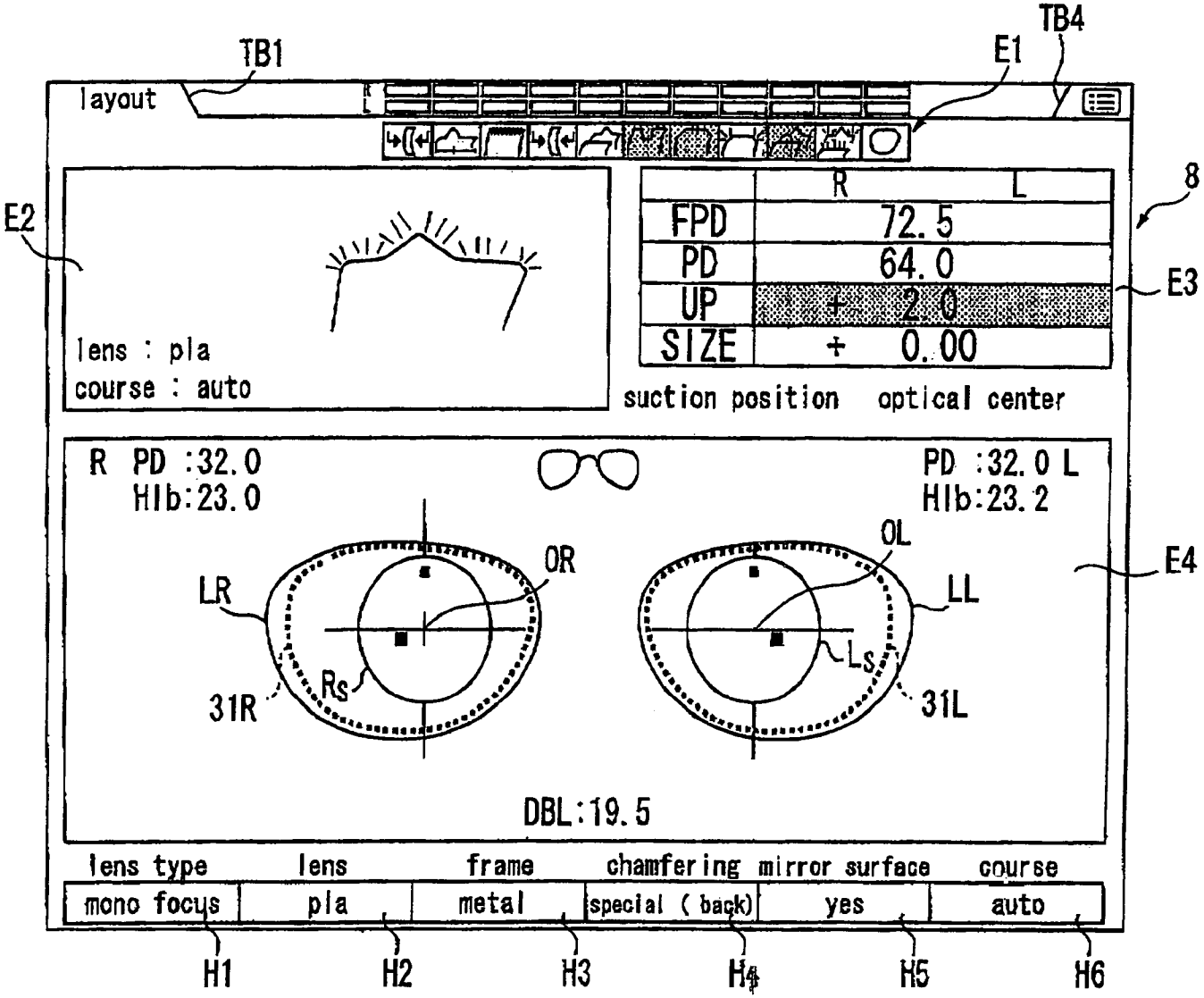
FIG. 9 is a view for explaining a state showing an example of display for a special chamfering on a screen.

There are "without", "small (front and back)", "middle (front and back)", "large (font and back)", "special (front and back)", "small (back)", "middle (back)", "large (back)", "special (back)" and so on, as shown in FIG. 9, as the kinds of processing of the chamfering inputted by the functional key F4.

In addition, a pop up showing a position of chamfering may be "without", "small (front and back)", "special ears (front and back)", "special nose (front and back)", "special (front and back)", "small (front and back)", "special ears (front and back)", "special nose (front and back)", "special (back)" or the like.

There are "without", "with", "mirror surface processing of chamfering portion" and so on, as the mirror processing inputted by the functional key F5.

There is "auto", "testing", "monitor", "frame change", "inner trace" or the like as the processing course inputted by the functional key F6.

Meanwhile, a mode, kind or order in the aforementioned functional keys F1 to F6 is not limited especially. The number of the key is not limited, for example, any functional keys may be provided to select "lay out", "processing", "processed", "menu" and so on, as the selection of the tabs TB1 to TB4.

The "lens type", "lens", "frame", "chamfering", "mirror surface processing" "course" and so on are displayed respectively on the functional displaying portions H1 to H6 corresponding to the functional keys F1 to F6. In addition, contents corresponding to the "lens type", "lens", "frame", "chamfering", "mirror processing", "course" and so on, that is to say, the above-mentioned kinds and contents of the processing to be selected by the functional keys F1 to F6 are displayed on the functional displaying portions H1 to H6.

Meanwhile, the display and operation and so on of "immediate aftermath of system actuation", "immediate aftermath of data demand", "termination of lay out setting", selection of each course" and so on, as a displaying state of the liquid crystal indicator 8 at the time of the lay out, or "confirmation of edge thickness", "during the pressing of right eye lens and termination", "during the processing of left eye lens" and so on, as a displaying state of the liquid crystal indicator 8 when processing, further "confirmation", "data storing", "error in grinding", "icon and cursor", "groove forming and chamfering", "trial grinding", "additional processing and re-finishing" and so on, as a displaying state of the liquid crystal indicator 8 after processed, may be the same as that in Japanese Patent Laid-Open Nos.

(Control Circuit)

Figure 4:
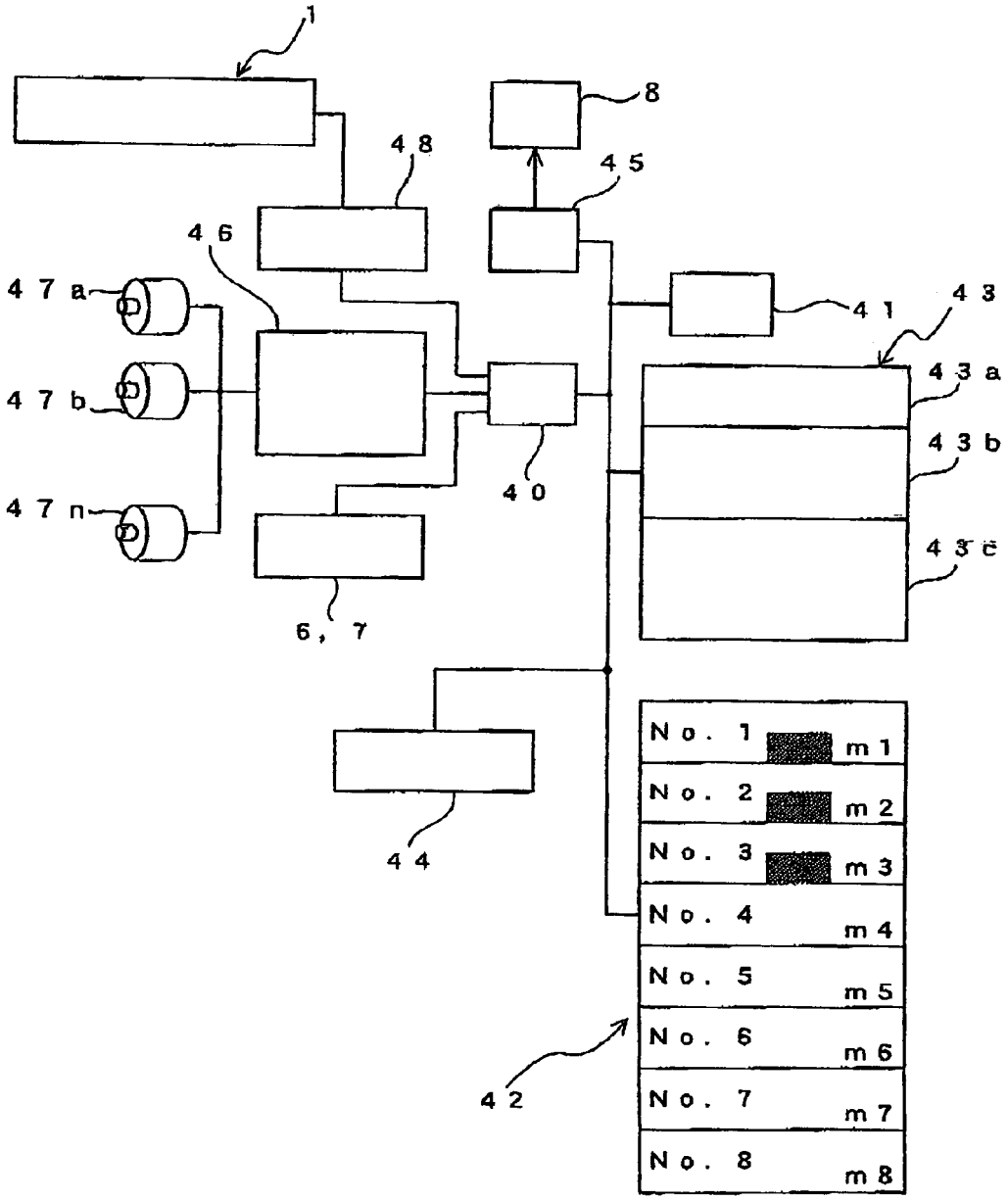
FIG. 4 is an explanatory view of a control circuit in the lens grinding apparatus.

The lens grinding apparatus 2 includes an arithmetic control circuit 40 as shown in FIG. 4. The arithmetic control circuit 40 has a CPU, and is connected with the operational panels 6 and 7, a ROM 41 as a storing means, a data memory 42 and a RAM 43 as storing mans and a memory 44 for a correction value. The arithmetic control circuit 40 is connected through a driver 45 for displaying with the liquid crystal indicator 8, is connected through a pulse motor driver 46 with various drive motors or pulse motors 47*a* to 47*n* of a driving system, and is connected through a communication port 48 with the apparatus 1 for measuring the frame shape as shown in FIG. 1.

Meanwhile, for example, it is assumed that the drive motor 47*a* is for moving upward and downward the carriage as described above, the drive motor 47*b* is for moving rightward and leftward the carriage, the drive motor 47*c* is for rotating the lens rotating shafts 9 and 10, the drive motor 47*d* is for rotating the grinding wheel 11, the drive motor 47*e* is for moving upward and downward the swinging arm 16, and the drive motor 47*f* is for rotating the grinding wheel 11.

In this case, it is possible to move upward and downward the carriage (not shown) by normal or reverse rotation of the drive motor 47*a* and to move rightward and leftward the carriage by normal or reverse rotation of the drive motor 47*b*. It is also possible to carry out normal or reverse rotation of the lens rotating shafts 9 and 10 by normal or reverse rotation of the drive motor 47*c*. Moreover, it is possible to rotate the grinding wheel 11 by operation of the drive motor 47*d* and to oscillate upward and downward the swinging arm 16 by normal or reverse rotation of the drive motor 47*e*. Furthermore it is possible to rotate the rotating (chamfering) shaft 15 by operation of the drive motor 47*f*. The drive motors 47*a* to 47*f* in the drive system are controlled by means of the arithmetic control circuit 40.

Figure 5:
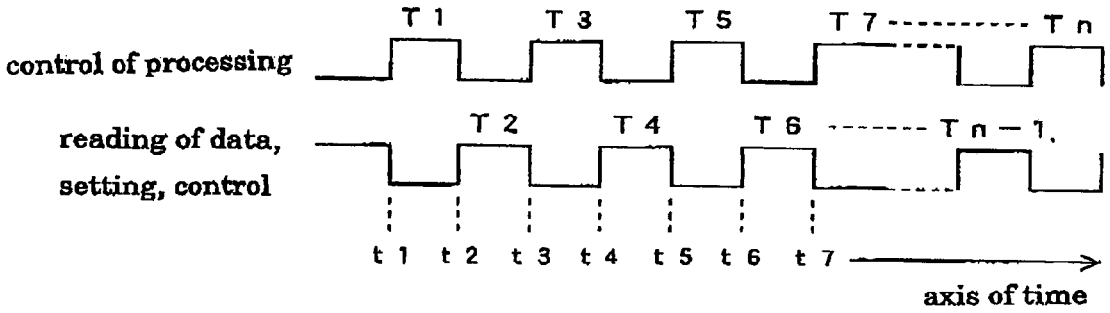
FIG. 5 is a view showing a time chart for explaining a control of the control circuit.

The arithmetic control circuit 40 controls the processing by time division, reading of data and setting of lay out if there are the reading of data from the frame shape measuring apparatus 1 and reading of data stored in storing areas m1 to m8 of the data memory 42 after initiation of the processing control, as shown in FIG. 5.

That is to say, assuming that a term between times t1 and t2 is T1, a term between times t2 and t3 is T2, a term between times t3 and t4 is T3, . . . , a term between times tn−1 and tn is Tn−1, the control of processing is carried out among the terms T1, T3, . . . Tn−1, and the controls of reading the data and of setting the lay out are carried out among the terms T2, T4, . . . Tn. Accordingly, the reading and storing of the next multi lens shape data, the reading out of data and lay out setting (adjustment) and so on can be carried out, during grinding the processed lens, and therefore an efficiency of working of data processing can be very enhanced.

Various programs and so on for controlling an operation of the lens grinding apparatus 2 are stored in the ROM 41. The data memory 42 is provided with a plurality of data storing areas.

The RAM 43 is provided with an area 43*a* for storing data during processing, an area 43*b* for storing new data, and an area 43*c* for storing frame data and processed data and so on.

Meanwhile, a readable and writable FEEPROM (flash EEROM) may be used for the data memory 42 and a RAM for a backup power source may be used so that contents in the data memory and so on are not deleted even if a main power source is turned off.

(Operation)

An operation of the lens grinding apparatus having the arithmetic control circuit 40 with the aforementioned structure will be explained below.

If the main power source is turned on, from the state of start standby, the arithmetic control circuit 40 judges whether or not there is the data reading from the frame shape measuring apparatus 1.

That is to say, the arithmetic control circuit 40 judges whether or not the "data demand" switch 7*c* in the operational panel 6 is pressed. Then, if the "data demand" switch 7*c* is pressed and there is the data demand, the data of the lens shape information(θi, ρi) from the frame shape measuring apparatus 1 are read into the data reading area 43*b* of the RAM 43. The read data may be stored in or recorded on either of the storing areas m1 to m8 of the data memory 42.

Figure 8:
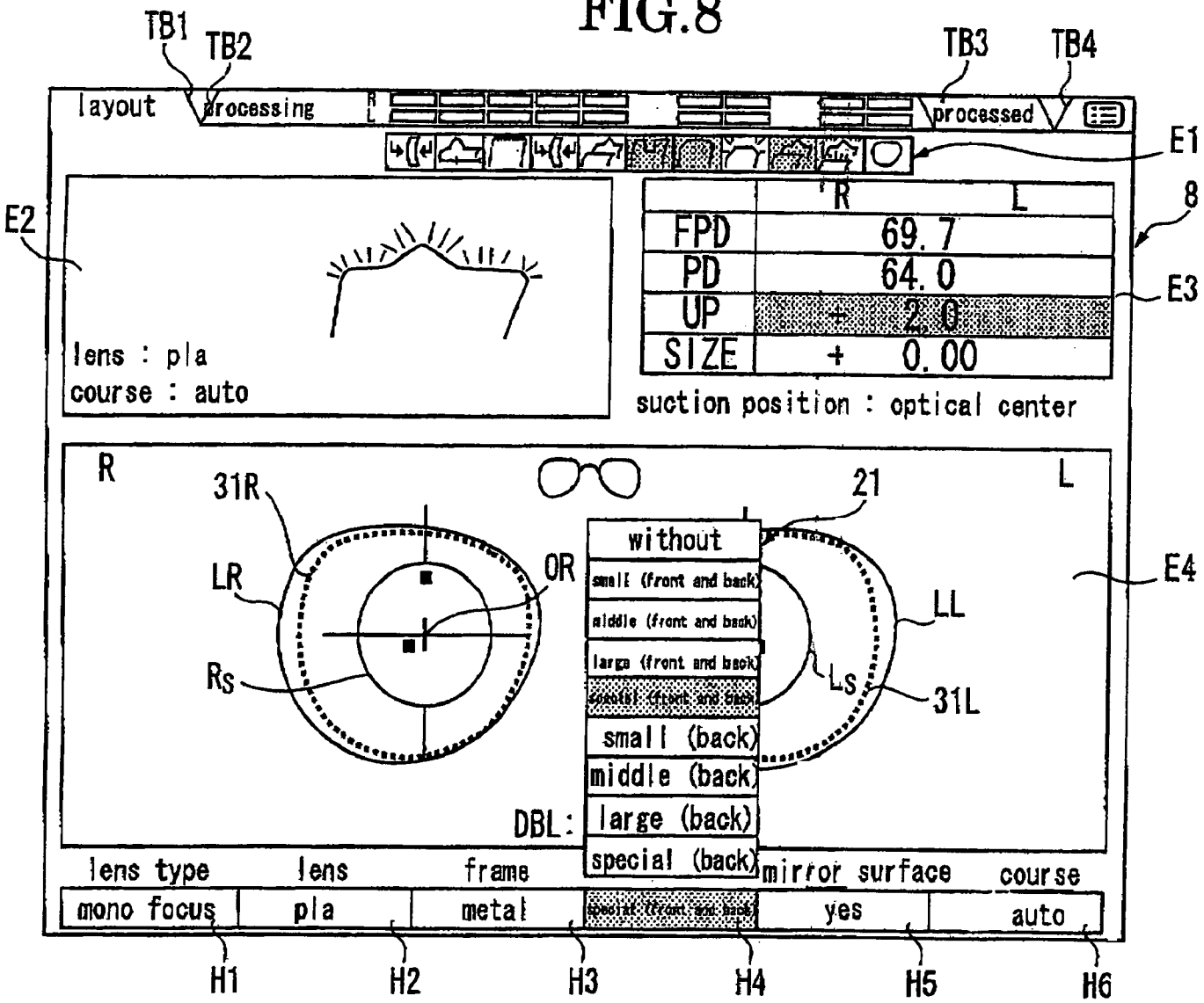
FIG. 8 is a view a state selecting "special (front and back)" in the popup menu shown in FIG. 7.

When the data of the lens shape information (θi ρi) are read, the arithmetic control circuit 40 is adapted to display on the liquid crystal indicator 8 the displaying contents for the lay out setting shown in FIG. 8.

Hereinafter, operational processes for a lay out setting in a normal chamfering, simulation of the chamfering and execution of the chamfering will be explained.

(1) Lay Out Display of the Liquid Crystal Indicator 8

Figure 6:
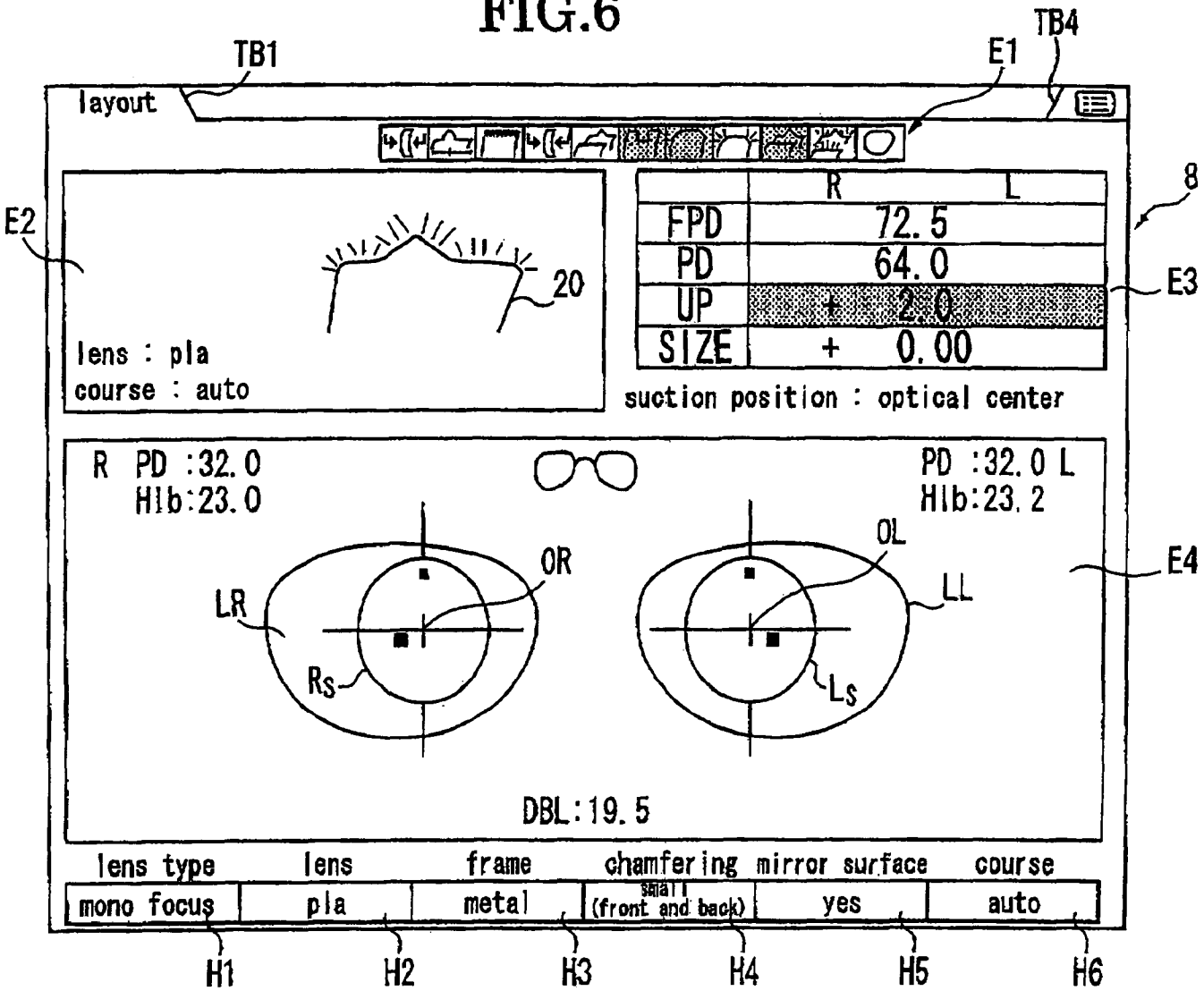
FIG. 6 is an explanatory view showing an example of display of a normal chamfering processing of the liquid crystal indicator.

When setting the lay out, the contents of the normal chamfering as shown in FIG. 6 are displayed on the liquid crystal indicator 8 by the arithmetic control circuit 40. In other words, "lens: pla", and "course: auto" are displayed on the displaying area E2 of the liquid crystal indicator 8 and a display 20 for processing the V shape and chamfering is carried out. The geometric center distance of the frames FPD, the distance PD between the pupils of the wearer, the corrected amount UP, the size and the numeric value are displayed on the displaying area E3. In FIG. 6, the FPD is 72.5, the PD is 64.0, the UP is +2.0, and the size is +0.00. The display of "suction position: optical center" is displayed on the displaying area E3 below the "SIZE".

Moreover, the right lens shape LR and the lens suction cup Rs are displayed to be overlapped on a left side of the displaying area E4, and the left lens shape LL and the lens suction cup Ls are displayed to be overlapped on a right side of the displaying area E4. At this time, an optical center OR of the lens shape LR and a center of the lens suction cup Rs are coincided, an optical center OL of the lens shape LL and a center of the lens suction cup Ls are coincided The "lens type", "lenses", "frame", "chamfering", "mirror surface" and "course" and so on are displayed respectively on the functional displaying portions H1 to H6, respectively. Moreover, for example, the "mono-focus" is displayed on the functional displaying portion H1, for example, "pla" on the functional displaying portion H2, for example, the "metal" on the functional displaying portion H3, for example, the "small (front and back)" on the functional displaying portion H4, for example, the "with" on the functional displaying portion H5, for example, the "auto" on the functional displaying portion H6.

Figure 7:
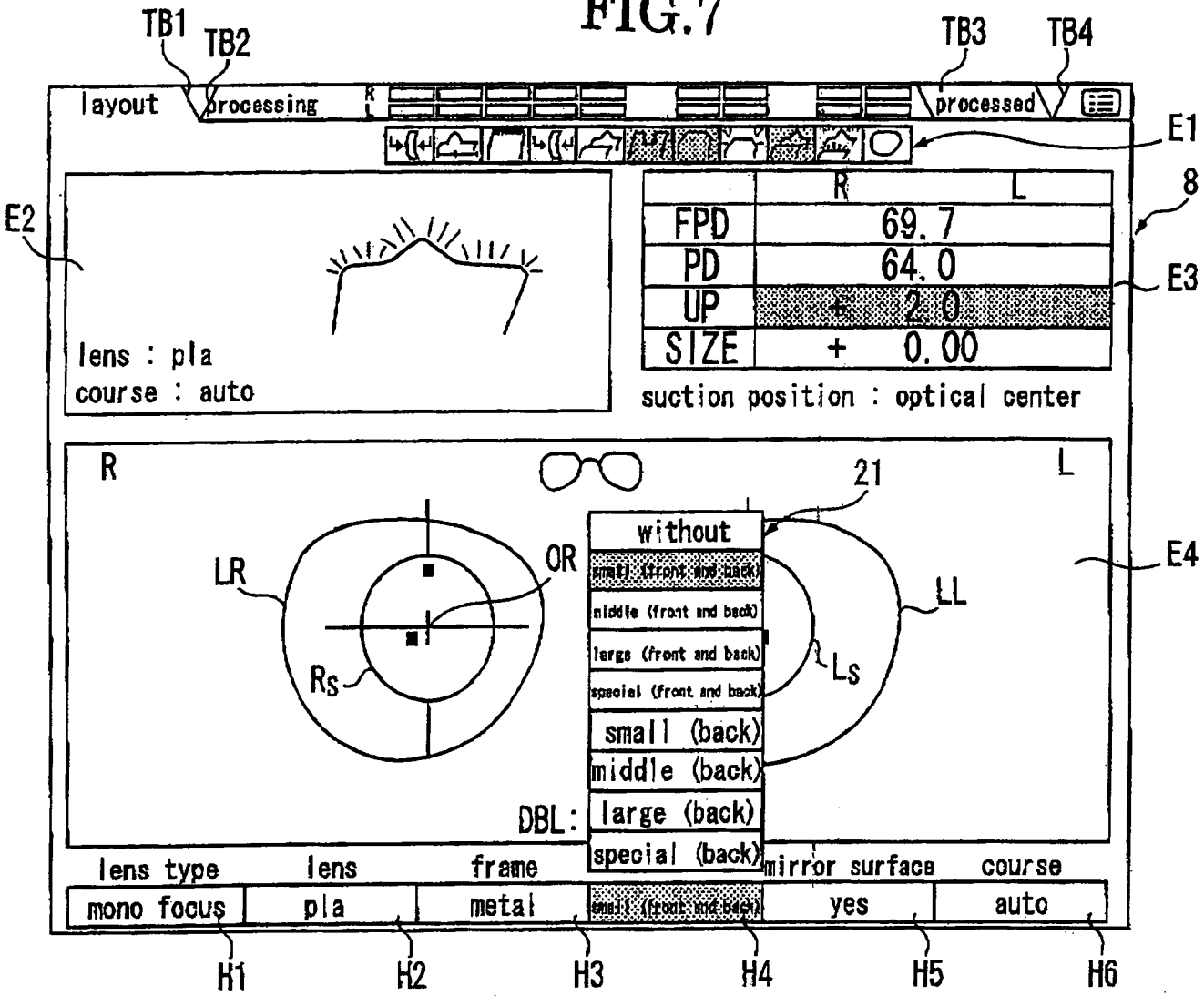
FIG. 7 is an explanatory view showing a popup menu displayed on the liquid crystal indicator.

When the functional key F4 corresponding to the functional displaying portion H4 is then pressed, the popup menu 21 is displayed, as shown in FIG. 7. Selected contents in the chamfering positions of "without", "small (front and back)", "middle (front and back)", "large (front and back)", "special (front and back)", "small (back)", "middle (back)", "large (back)", and "special (front and back)" and so on are displayed on the popup menu 21. In the displaying condition, whichever of the colors in the chamfering positions of "without", "small (front and back)", "middle (front and back)", "large (front and back)", "special (front and back)", "small (back)", "middle (back)", "large (back)", and "special (back)" and so on is displayed in a reversed state. The reversed content is a position of chamfering and displayed on the functional displaying portion H4. In FIG. 7, the "small (front and back)" is displayed as the position of chamfering.

The reversed display for the chamfering position is executed in turn with respect to the "without", "small (front and back)", "middle (front and back)", "large (front and back)", "special (front and back)", "small (back)", "middle (back)", "large (back)", and "special (back)" and so on, every time the functional key F4 is pressed.

When the "special (front and back)" is selected by means of the functional key F4, the "special (front and back)" is displayed in a reversed state on the functional displaying portion H4, as shown in FIG. 8 and the shift to the special chamfering course is carried out. Traces 31R and 31L of the chamfering after the processing of chamfering are displayed on the lens shape LR and LL. In this case, the chamfering traces of a portion (nose side) adjacent the nose and a portion (ear side) far away form the nose in the edge of the eyeglass lens are displayed, with standard values, for example, a chamfering width of 2.00 mm and a chamfering range of 80% or the like.

Meanwhile, the "small (front and back)", "middle (front and back)", and "large (front and back)" mean the magnitude, "small", "middle" and "large" of the chamfering width and the locations, "front side" and "back side" for chamfering the edge end of the eyeglass lens ML, in the normal processing of chamfering. Similarly, the "small (back)", "middle (back)", and "large (back)" mean the magnitude, "small", "middle" and "large" of the chamfering width and the location, "back side" for chamfering the edge end of the eyeglass lens ML, in the normal processing of chamfering. The "special (front and back)" means the processing of chamfering in a position (hereinafter, referred to as ear side) of the eyeglass lenses ML located in the vicinity of a temple of the eyeglass frame, in the processing of chamfering of the edge end of the anterior and posterior refractive surfaces of the eyeglass lens ML, or in a position (hereinafter, referred to as nose side) of the eyeglass lens located in the vicinity of a nose pad. The "special (back)" means "without chamfering" of the edge end in the anterior refractive surface of the eyeglass lens ML and the processing of chamfering in the ear side or nose side in edge end of the posterior refractive surface.

(2) Operation of Chamfering in a Simulation Screen

As shown in FIG. 9, after the display for the special chamfering is executed, if the chamfering of the eyeglass lens for the left eye in the simulation screen is carried out, the "monitor" is selected by the functional key F6 from the "auto", "trial", "monitor", "frame change", and "inner trace", and then the processing is started by pressing the left switch 6*b*. The simulation screen as shown in FIG. 11 is displayed on the liquid crystal indicator 8 after measuring a bottom portion or shoulder portion of a mountain part of the V shape in case of the processing of the V shape, or a shape (lens shape) of the edge thickness of an unprocessed eyeglass lens in the periphery of the lens shape in case of processing the V shape.

If the simulation operation is not carried out, a shift to the processing of chamfering of the V shape or flat shape is exerted by selection of "auto". However, the display during processing is held in the simulation screen.

Figure 11:
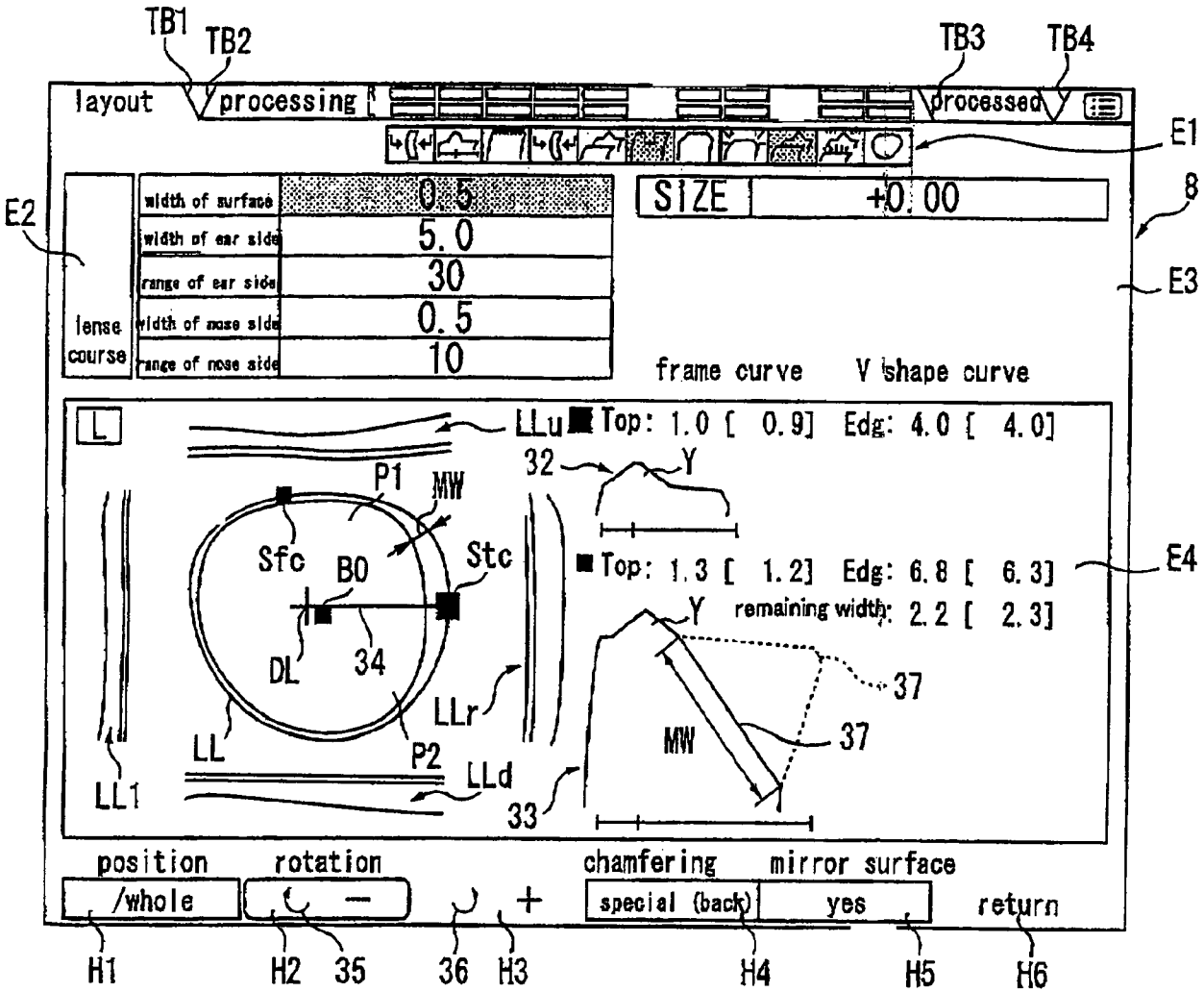
FIG. 11 is an explanatory view showing a state in which a simulation screen is displayed on the liquid crystal indicator.

In FIG. 11, "width of surface", "width of ear side", "range of ear side", "width of nose side", and "range of nose side" of the chamfering of the eyeglass lens for the left eye are displayed on the displaying area E2 of the liquid crystal indicator 8. For example, the matters and so on that the width of surface is 0.3 mm, the width of ear side is 2.0 mm, the range of the ear side is 90%, the width of the nose side is 1.0 mm, and the range of the nose side is 90% are displayed. The matters of "curve of frame" and "curve of V shape" are also displayed on the lower portion of the displaying area E3.

Furthermore, "left eye mark L", "lens shape L for left eye", "optical center OL of lens shape LL", "geometric center BO of lens shape LL", "upper width LLu of lens", "lower width LLd of lens", "width LLr of right lens", "width LLl of left lens", "special chamfering positional mark Stc" used as a mark (eye mark) showing any position, and "chamfering positional mark Sfc" showing the most thinning position of the widths of the edge thickness and the chamfering, are displayed on the left side of the displaying area E4.

A sectional shape 32 at the chamfering positional mark Sfc of the lens shape LL is first displayed, and for example an apex of V shape "Top: 1.0 [0.9]" and "Edg: 4.0 [4.0]" are first displayed on an upper portion of the right side of the displaying area E4. Simultaneously, a sectional shape 33 of the edge at the special chamfering positional mark Stc in a horizontal direction at the ear side of the lens shape LL is first displayed and for example, the apex of the V shape "Top: 1.3 [1.2]", "Edge: 6.8 [6.3]", "remaining width: 2.2 [2.3]" and so on are first displayed on a lower portion of the right side of the displaying area E4.

Matters of "position" corresponding to the functional displaying portion H1, "rotation" corresponding to the functional displaying portion H2, "chamfering" corresponding to the functional displaying portion H4, "mirror surface" corresponding to the functional displaying portion H5, and "return" corresponding to the functional displaying portion H6 are displayed on the lower edge portion of the liquid crystal indicator 8, respectively. In addition, reference Y denotes a mountain of the V shape of the lens shape LL.

Moreover, a pointer 34 extending to the special chamfering positional mark Stc centering on the optical center OL of the lens shape LL is displayed to overlap on the lens shape LL. The pointer 34 and the special chamfering positional mark Stc are adapted to move on the lens shape LL clockwise (direction of minus (−)), as the arrow 35 shown on the functional displaying portion H2, when pressing the functional key F2. The pointer 34 and the special chamfering positional mark Stc are also adapted to move on the lens shape LL counterclockwise (direction of minus (+)), as the arrow 36 shown on the functional displaying portion H3, when pressing the functional key F3. Following to the movement of the pointer 34 and the special chamfering positional mark Stc, a state of a chamfering portion 37 at a position of the movement is displayed on the lower portion of the right side of the liquid crystal indicator. For example, by the above movement, when the pointer 34 and the special chamfering positional mark Stc are moved toward the chamfering positional mark Stf, the state of the chamfering portion 37 is changed as shown in the broken lines.

In the normal simulation screen, "size" is displayed on the lower portion of the displaying area E3 (data inputting portion).

Changing the setting value of the chamfering width results in alternation of a width of chamfering other than the special chamfering portion. The "width of the car side" and "range of special chamfering", "width of nose side" and "range of special chamfering" are settable, respectively.

In other words, in initial setting values of the special chamfering of the ear side, for example, the width of chamfering of ear side is 2.0 mm, the range of chamfering of ear side is 90%, the width of chamfering of nose side is 0.3 mm, the range of chamfering of nose side is 90%, and the width of surface is 0.3 mm. In initial setting values of the special chamfering of the nose side, for example, the width of chamfering of ear side is 0.3 mm, the range of chamfering of ear side is 90%, the width of chamfering of nose side is 1.0 mm, the range of chamfering of nose side is 90%, and the width of surface is 0.3 mm. In initial setting values of the special chamfering, for example, the width of chamfering of ear side is 2.0 mm, the range of chamfering of ear side is 90%, the width of chamfering of nose side is 1.0 mm, the range of chamfering of nose side is 90%, and the width of surface is 0.3 mm. A changeable range of the chamfering width of the ear side or the nose side is, for example, 0.1 mm to 5.0 mm and a changeable range of the chamfering range is for example, 10% to 90%. A changeable range of the width of surface is for example, 0.1 mm to 5.0 mm. Meanwhile, the aforementioned ranges in the initial set values are examples and therefore the initial setting values are not limited to the ranges as described above.

Hereinafter, the range of chamfering will be further explained.

Figure 15:
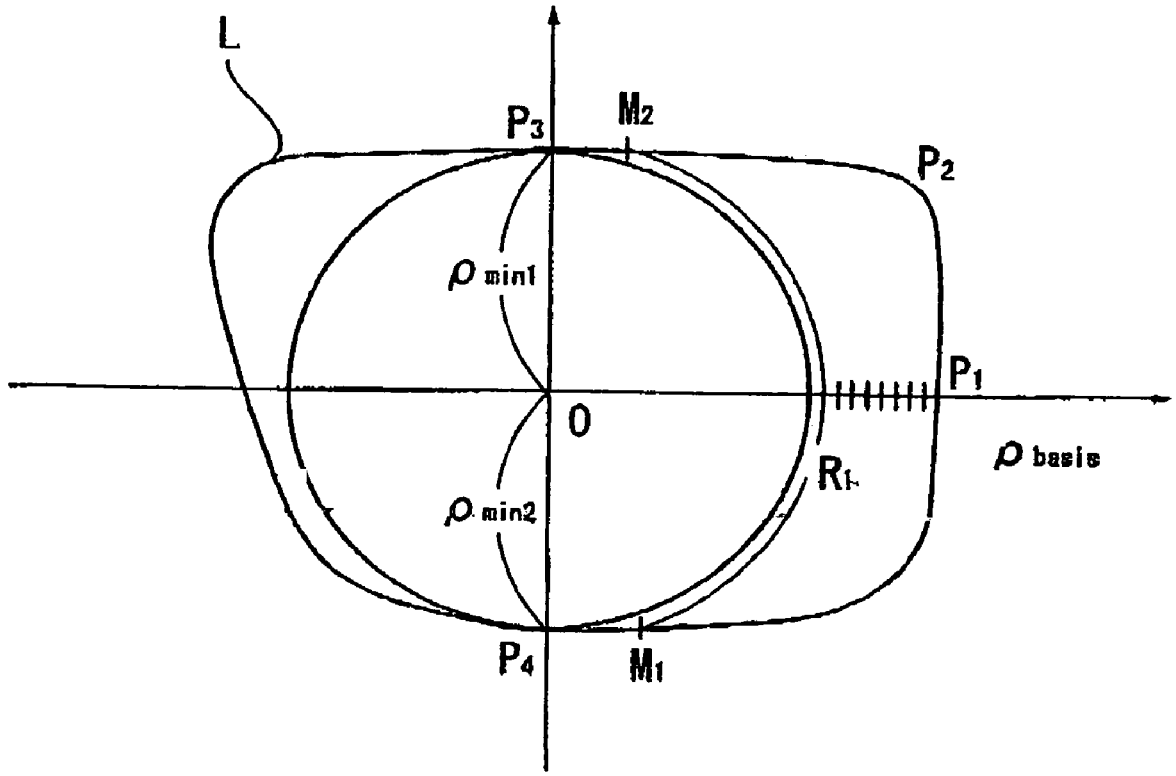
FIG. 15 is an additional explanatory view for explaining one example of a range of chamfering.
Figure 16:
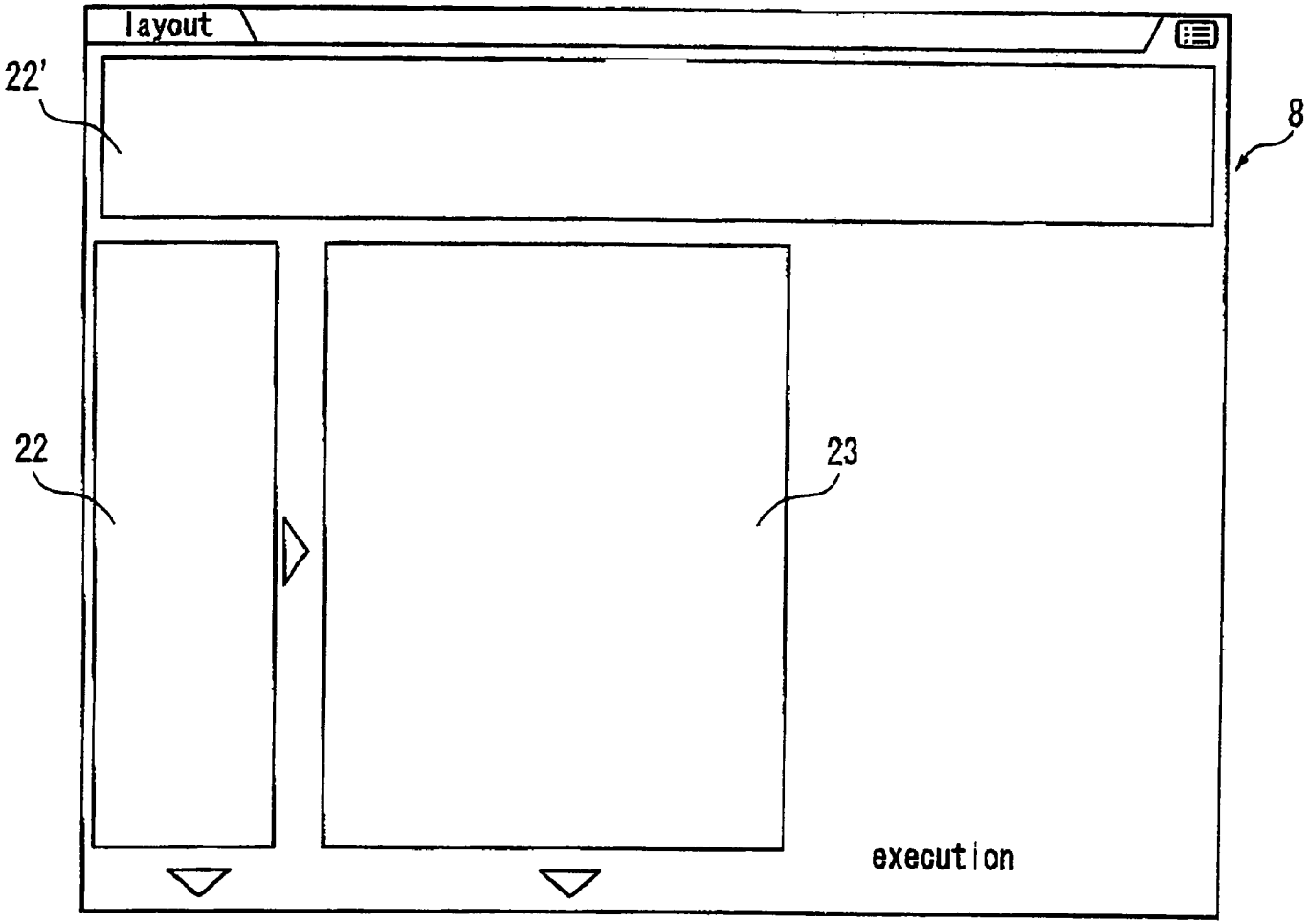
FIG. 16 is an explanatory view showing a sate displaying a screen for selecting items.

As shown in FIG. 15, now, in a radius, vector ρ of the lens shape L centering on the geometric center O, when a lateral radius vector (reference of polar coordinates) thereof is $OP_1$ and a magnitude thereof is $\rho_{basis}$, a smaller value of magnitudes $\rho_{min1}$ and $\rho_{min2}$ of the minimum radius vectors $OP_3$ and $OP_4$ is a magnitude, $\rho_{min}$, and a circle of a radius, $\rho_{min}$ centering on the geometric center O is drawn. Here, the matter that the range of chamfering is 90% means, when dividing the magnitude, $R_1$ $P_1$ ($\rho_{basis}-\rho_{min}$) into 100 parts in the lateral radius vector, drawing a concentric circular arc centering on a geometric center O passing a location of 10 scales, and points that the circular intersects with contour lines of the lens shape are $M_1$ and $M_2$, a range of a peripheral edge portion of the lens shape separated at the intersecting points $M_1$ and $M_2$.

In this way, when the range of chamfering is changed in the range of 10% to 90%, because the appearance of chamfering of the preview screen 24*g* of the liquid crystal indicator 8 is also changed, it is possible to change the range of chamfering or width of chamfering while viewing the preview screen 24*g* to the wearer of the eyeglasses.

A first line of chamfering is displayed based on a width set in "initial value of size". However, if a numeric value is changed on the lay out screen, the chamfering line is displayed by the numeric value inputted at that time and the lay out screen is changed. A worker of the eyeglasses can confirm visually a simulation of the processing of chamfering.

A matter "remaining width of edge" after the special chamfering is displayed under the display of the "edge thickness" in the displaying portion of the edge section and a user can confirm the edge thicknesses of the right and left lenses, after chamfering them, if the user hopes to be same the edge thicknesses.

When the special chamfering processing of one lens is terminated, an amount of grinding another lens is not depended on the width of surface and the range in the initial setting and is computed and decided so that a width of grinding (remaining width of edge) is the same as that of the one lens.

Moreover, the data such as the "width of surface", "widths of surface of nose and ear sides" and "ranges of nose and ear sides" which are changed on the simulation screen are applied in processing the another lens as described above.

In addition, setting/cancellation of the special chamfering can be carried out on the simulation screen.

(3) Process of Chamfering

In the simulation as described above, the state of the chamfering is confirmed and if the state has no problem, the rough processing is initiated by pressing the left switch 6*b* for initiating the processes. After the rough processing is carried out, the edge thickness of the lens is measured along the trace of the chamfering under the conditions of the setting of chamfering as described above. The special chamfering processing is then initiated. At this time, the arithmetic control circuit 40 controls the operation of the drive motor 47*f* to rotate the chamfering shaft 15 integral with the grinding wheels 13 and 14 for chamfering, while controls the drive motor 47*e* based on the setting conditions of the special chamfering as described in the above (1) to swing upward and downward the swinging arm 16 and to cry out the processing for chamfering on the eyeglass lens for the left eye by the grinding wheels 13 and 14 for chamfering.

However, if the grinding wheel interferes with the V shape or a groove for a wire, a message for executing a forced chamfering and groove processing operation is displayed similarly as the normal processing for chamfering to inform the user of changing from the chamfering shape on the screen (4) Next, the Chamfering Display for the Processing of the V Shape and Groove Forming, the Processing of the V Shape and the Groove will be explained.

A. The Chamfering Display for the Groove and V Shape (In Case of the V Shape)

As described above, the simulation screen for the processing of the V shape is displayed as shown in FIG. 11, in accordance with the displaying setting for the lay out, in the liquid crystal indicator 8 as described in the above (1).

(In Case of Groove Forming)

The simulation screen for processing the groove can be displayed similarly as the processing of the V shape.

In this case, similarly as the simulation screen of the V shape processing, "left eye mark L", "lens shape LL for left eye", "optical center OL of lens shape LL", "geometric center BO of lens shape LL", "upper width LLu of lens", "lower width LLd of lens", "width LLI of left lens", "special chamfering positional mark Stc" used as a mark (eye mark) showing any position, and "chamfering positional mark Sfc" showing the most thinning position of the widths of the edge thickness and the chamfering, are displayed on the left side of the displaying area E4. Meanwhile, the display of the displaying area E2 is also displayed similarly as the simulation screen of the V shape processing.

The sectional shape 32 at the chamfering positional mark Sfc of the lens shape LL is first displayed, and for example, "Front: 1. 3" and "Edge: 4.0" showing that the wire groove 38 is in a position of 1.3 mm from the front side are displayed on the upper portion of the right side of the displaying area E4. Simultaneously, the sectional shape 33 (see FIG. 13) of the edge at the special chamfer positional mark Stc in a horizontal direction at the ear side of the lens shape LL is first displayed on and for example, "Edge: 6.9", "remaining width: 2.9" and so on are first displayed on the upper portion of the right side of the displaying area E4.

Hereinafter, a method relating to the optimization of the width of the anterior bottom portion (anterior edge portion), the width of the posterior bottom portion (posterior edge portion) and the chamfering width of the edge surface will be explained.

Regarding a method for setting variably the width of the posterior edge surface of the eyeglass lens with respect to the entire peripheral edge of the eyeglass lens, it is assumed that a method for setting the maximum width of the entire periphery is a first setting method and a method for setting the width of posterior bottom portion (posterior edge portion) centered on the V shaped mountain or groove of the edge surface on which the V shape processing or groove processing is carried out, to a width larger than the width of the anterior bottom portion (anterior edge portion) by a constant proportion is a second, setting method.

If the chamfering width by the second setting method is large than the setting width of the first setting method, the first setting method is prioritized over the second setting method to follow the setting width by the first setting method, if the chamfering width by the second setting method is less than the setting width of the first setting method, the second setting method is prioritized over the first setting method to follow the setting width by the second setting method and to set the chamfering width to the setting width by the first setting method.

For example, when the setting width of the first setting method is 2.0 mm, the setting position of the mountain of V shape or groove is a position of 30% of the entire width of the edge surface from the front side, a proportion of the width of the posterior bottom (posterior edge portion) to the width of the anterior bottom (anterior edge portion) is 1:1, the variation in the position of the mountain or groove of the V shape and the width of the posterior bottom (posterior edge portion) in variation of the edge width in a range of 3.0 mm to 8.0 mm is shown in FIG. 15.

Figure 14:
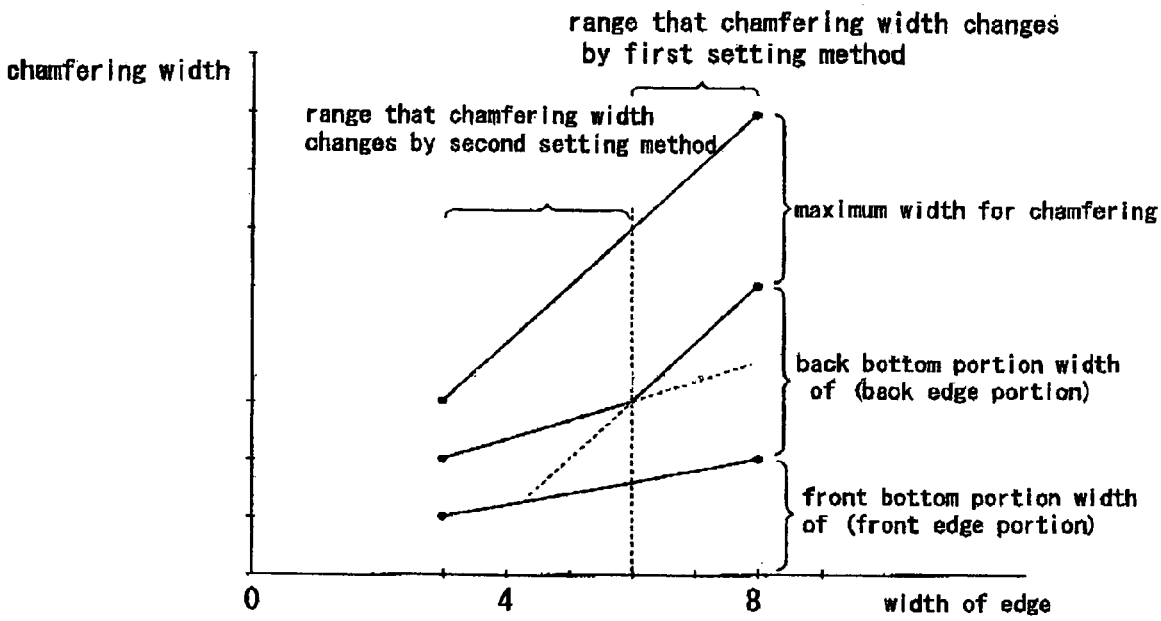
FIG. 14 is a view showing a position of a mountain of a V shape and change of a width of a back bottom portion.

It is possible to realize the chamfering processing of the eyeglass lens in which the thickness of the edge surface is not appealing and whose appearance is good, throughout the entire periphery of the eyeglass lens, as the wearer of the eyeglasses hopes, and a strength for supporting a wire frame such as the NYLOL (registered trade mark) is sufficient, by setting the chamfering width of the edge surface so that each of the width of the anterior bottom, the width of the posterior bottom and the chamfering width of the edge surface becomes the optimum balanced size, as shown in FIG. 14.

In other words, the setting method of "width of surface", "width of ear side", "range of ear side", "width of nose side", "range of nose side" and so on is according to the first setting method, whereas, for example, the display of "Front: 1.3", "Edge: 6.9", "remaining width: 2.9" and so on is according to the second setting method. An eclectic setting method of the first and second setting methods is executed in order to use effectively their setting methods.

B. Processing of V or Flat Shape

If the processing of the V shape or flat is executed, the "left" switch 6*b* is pressed again to start the processing.

The arithmetic control circuit 40 controls the drive motor 47*d* to rotate the grinding wheel 11, on the other hand, controls normal or reverse rotation of the drive motor 47*a* based on the lens shape information (θi ρi) to move upward and downward the not shown carriage and then to move upward and downward the front end of the carriage every the angle θi, whereby, moving upward and downward the lens rotating shafts 9 and 10 and the eyeglass lens ML, so that the center distance between the lens rotating shafts 9 and 10, and the shaft 12 of the grinding wheel becomes "a radius of the grinding wheel plus (+) radius vector ρi" every the angle θi. Thereby, the eyeglass lens ML is roughly processed by the grinding wheel 11 based on the lens shape information (θi ρi).

Thereafter, if the "chamfering" is set other than "without" by operation of the functional key F4 at the time of the lay out, the measurement of the lens shape is executed.

The arithmetic control circuit 40 controls each of the drive motors 47*a* and 47*d*, similarly as the above based on the lens shape information (θi ρi) to process the mountain Y of the V shape at the edge end on the peripheral edge of the eyeglass lens ML roughly ground on each of the lens shapes LL and LR, by means of the wheel 11*b* for processing the V shape in the grinding wheel 11. In case of the flat processing, the processing for grinding is carried out by a planar portion of the wheel.

At this time, the arithmetic control circuit 40 controls the drive motor 47*b* moving rightward and leftward the carriage based on the V shape positional data which is previously set, so that the V shape processing is formed on the edge end of the eyeglass lens ML roughly ground into the lens shape. In the planar processing, the edge positional data of the front surface of the lens are used as the V shape positional data. The V shape positional data or front edge positional data are acquired from the refractive surface positional data in the axial direction of the measuring shaft 19*c* in a position corresponding to the lens shape information (θi ρi) of the anterior refractive surface fa or the posterior refractive surface fb of the eyeglass lens ML obtained in measuring the edge thickness of the eyeglass lens ML (see FIG. 13). For example, the positional data of a portion positioned in a direction of the edge thickness by a predetermined position from the refractive surface positional data of the anterior refractive surface fa or posterior refractive surface fb based on the lens shape information (θi ρi) are the V shape positional data. Such the positional data for the processing of the V shape can be acquired by a well known method.

C. Processing of Groove

If whichever of the "groove forming (thin)", "groove forming (middle)" and "groove forming (thick)" is selected by operation of the functional key F3 at the time of the lay out, the processing for the groove forming is executed.

The arithmetic control circuit 40 controls the drive motor 47*f* to rotate the shaft 15 for chamfering or forming the groove, integral with the grinding wheels 13 and 14 for chamfering, the groove forming cutter 17 and so on, while, controls the drive motor 47*e* based on the setting conditions of the special chamfering as described in the above (2) or (4) to swing upward and downward the swinging am 16 so that the a wire groove 38 whose end surface is opened, is ground on the edge end of the eyeglass lens ML roughly ground into each of the lens shapes LL and LR by means of the groove forming cutter 17.

Figure 13:
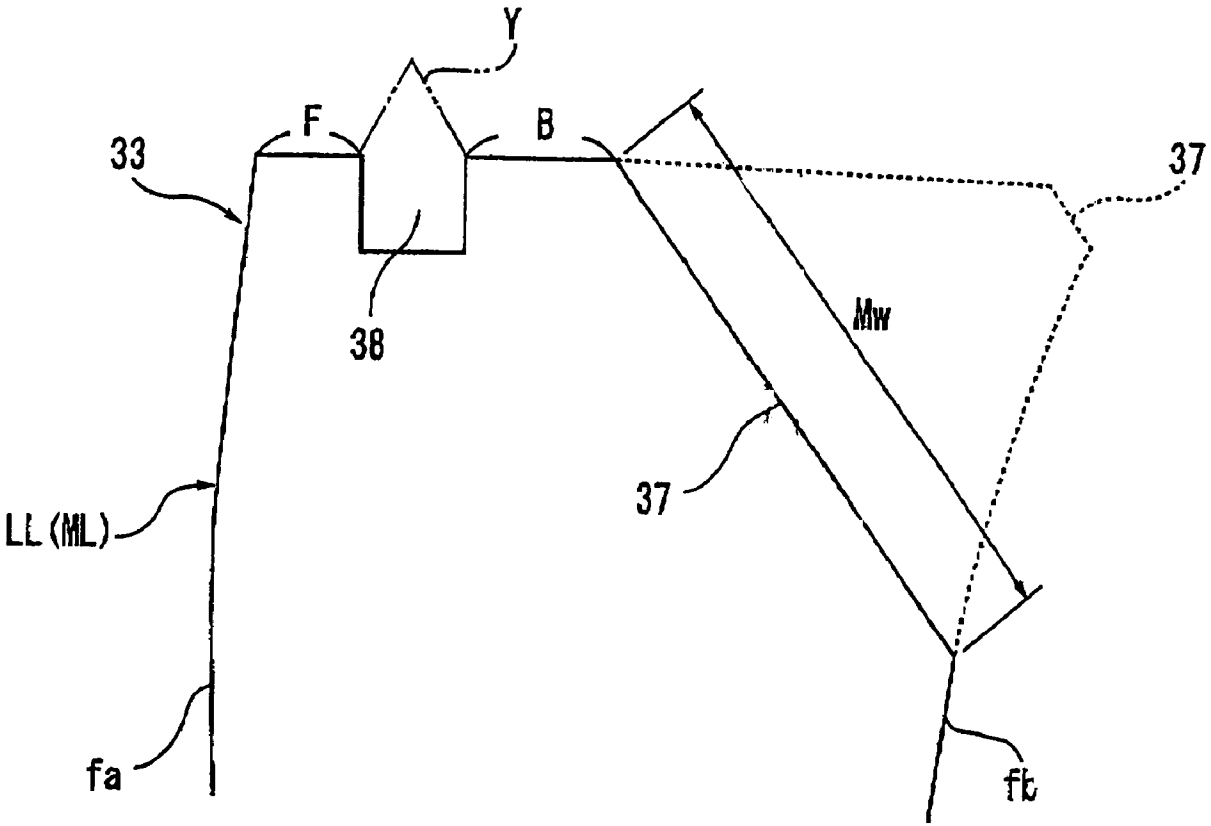
FIG. 13 is an explanatory view of a sectional of an edge.

In this case, the wire groove 38 is formed at a position at which the front edge portion F of a predetermined width is obtained in a direction of the edge thickness of the eyeglass lens ML from the anterior refractive surface fa of the eyeglass lens ML as shown in FIG. 13. The front edge portion F of the predetermined width is 1.3 mm, for example. A reason for setting the front edge portion F of the predetermined width is for securing a required minimum strength to prevent a forward portion of the wire groove 38 in the eyeglass lens ML from dropping out when processing the wire groove 38 on the edge end of the eyeglass lens ML by the groove forming cutter 17. Moreover, another reason for setting the front edge portion F of the predetermined width is to for preventing the front edge portion F from dropping out, when a force is applied to the front edge portion F in a state that the eyeglass lens is supported by the wire fame by disposing the wire frame such as the NYLOL (registered trade mark) in the wire groove 38.

In addition, although the required minimum strength of the front edge portion F is secured as 1.3 mm, for example, the strength is not limited to the numeric value, necessarily. The front edge portion F may be large than 1.3 mm.

Of course, a width of the front edge portion F is changed pursuant to a material and soon of the eyeglass lens.

D. Processing for Chamfering

At the time of the lay out, if "chamfering" is set other than "without" by the functional key F4, the processing for chamfering is carried out. The arithmetic control circuit 40 controls the drive motor 47*f* to rotate the shaft 15 for chamfering or forming the groove, integral with the grinding wheels 13 and 14 for chamfering, the groove forming cutter 17 and so on, while, controls the drive motor 47*e* based on the setting conditions of the special chamfering as described in the above (2) or (4) to swing upward and downward the swinging arm 16 so that the processing for chamfering is carried out on the eyeglass lens ML by the grinding wheels 13 and 14 for chamfering. The chamfering processing is executed on the anterior refractive surface fr of the eyeglass lens ML and corners of the eyeglass lens ML and the edge end. At this time, if "C. groove processing" is carried out, because the control of oscillation of the swinging arm 16 by the drive motor 47*e* is not required, the control of oscillation is not carried out, and the chamfering processing by the grinding wheels 13 and 14 for chamfering is directly executed.

(If the Wire Groove 38 is Provided)

Figure 12:
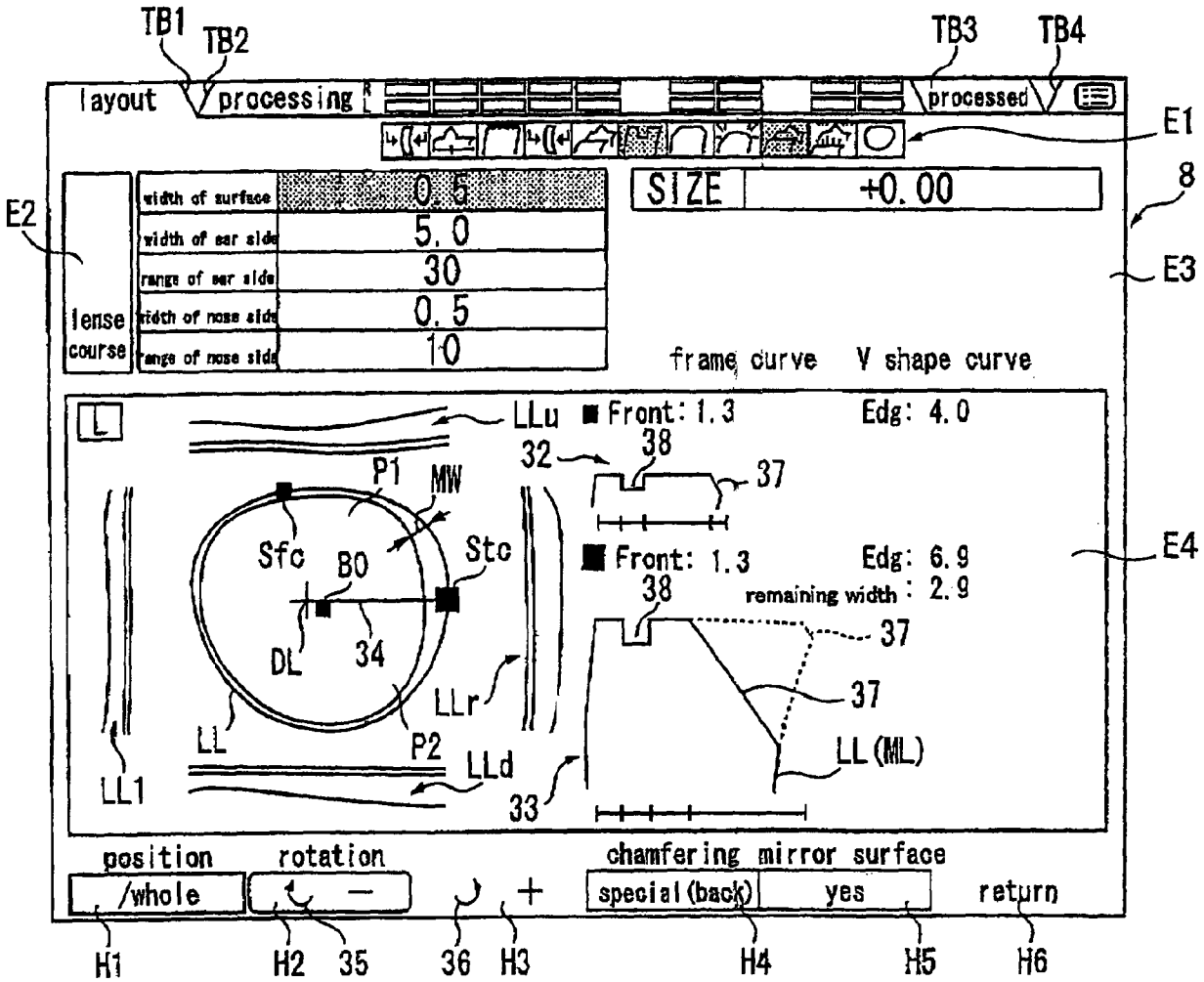
FIG. 12 is a view showing a state displaying a simulation for processing a groove.

For example, in the edge surface of the eyeglass lens ML, on which the groove is formed, a width of the back edge surface 3 centered on the wire groove 38 is set to become large than that of the front edge surface. In this case, as shown in FIG. 12, if the front edge portion F is 1.3 mm, the remaining width Mw for chamfering is set to 2.9 mm in the processing for chamfering so as to enable the back edge portion B to have the width of 1.6 mm which is a size of 1.2 times of the front edge portion F.

As a result, because it is possible to large the width of the back edge portion B than the front edge portion F and to process the chamfering throughout the entire peripheral edge of the lens shape of the eyeglass lens ML, it is possible to realize the chamfering processing in which the thickness of the edge surface is appealing throughout the entire peripheral edge of the eyeglass lens ML.

(If the Mountain of the V Shape is Provided)

In the V shape processing on which the mountain Y of the V shape is formed instead of the wire groove 38, it is possible to acquire the size of the chamfering width by computation by set the width of the back edge portion B (back bottom portion) largely than that of the front edge portion F (front bottom portion) centering on the mountain Y of the V shape and to form desired front and back bottom portions by processing the chamfering in accordance with the obtained chamfering width.

In this case, a method relating to the optimization of the widths of the front and back bottom portions or front and back edge portions and the chamfering width of the edge surface is set as described above.

As described above, the working processes of the setting of the layout, the simulation and the execution of processing, in the normal chamfering processing have been described.

However, there may be a demand for desiring to realize a now how of a technical chamfering processing technology which has been carried out by hands of an operator in eyeglass workings, by changing the initial setting, and to carry out the chamfering processing finely.

In such a case, it is necessary to change the initial display and the initial setting in the special chamfering, in addition to the working processes in the normal chamfering processing.

(5) Initial Display and Setting of "Special" in the Special Chamfering

Figure 19:
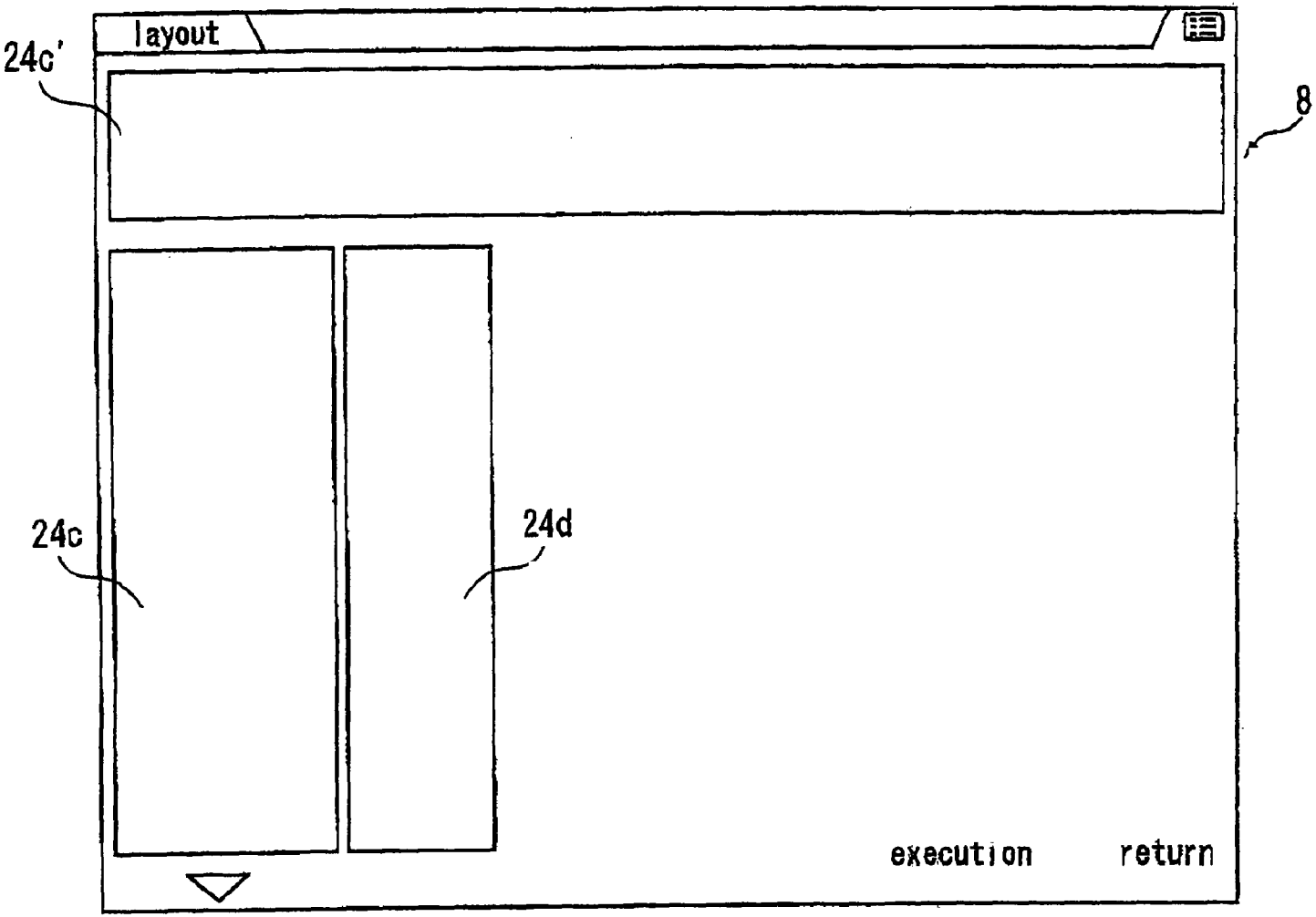
FIG. 19 is a view showing a screen displayed when selecting "width of chamfering (ear side)" in the screen shown in FIG. 17.

By pressing the "menu" tab TB4 or the "screen" switch 7*a*, as shown in FIG. 19, a message 22' of "please select items" and selecting menus 22 and 23 are displayed on the liquid crystal indicator 8. At this time, setting items of "setting 1", "setting 2", "adjustment", "maintenance" and so on are displayed on the selecting menu 22. When selecting the "setting 1" by the F1, setting items of "initial display of switches", "change of order of switches", "initial value of lay out", "screen of display", "setting of layout inputting", "initial value of size", "initial value of special chamfering" and so on are displayed on the selecting menu 23.

Figure 17:
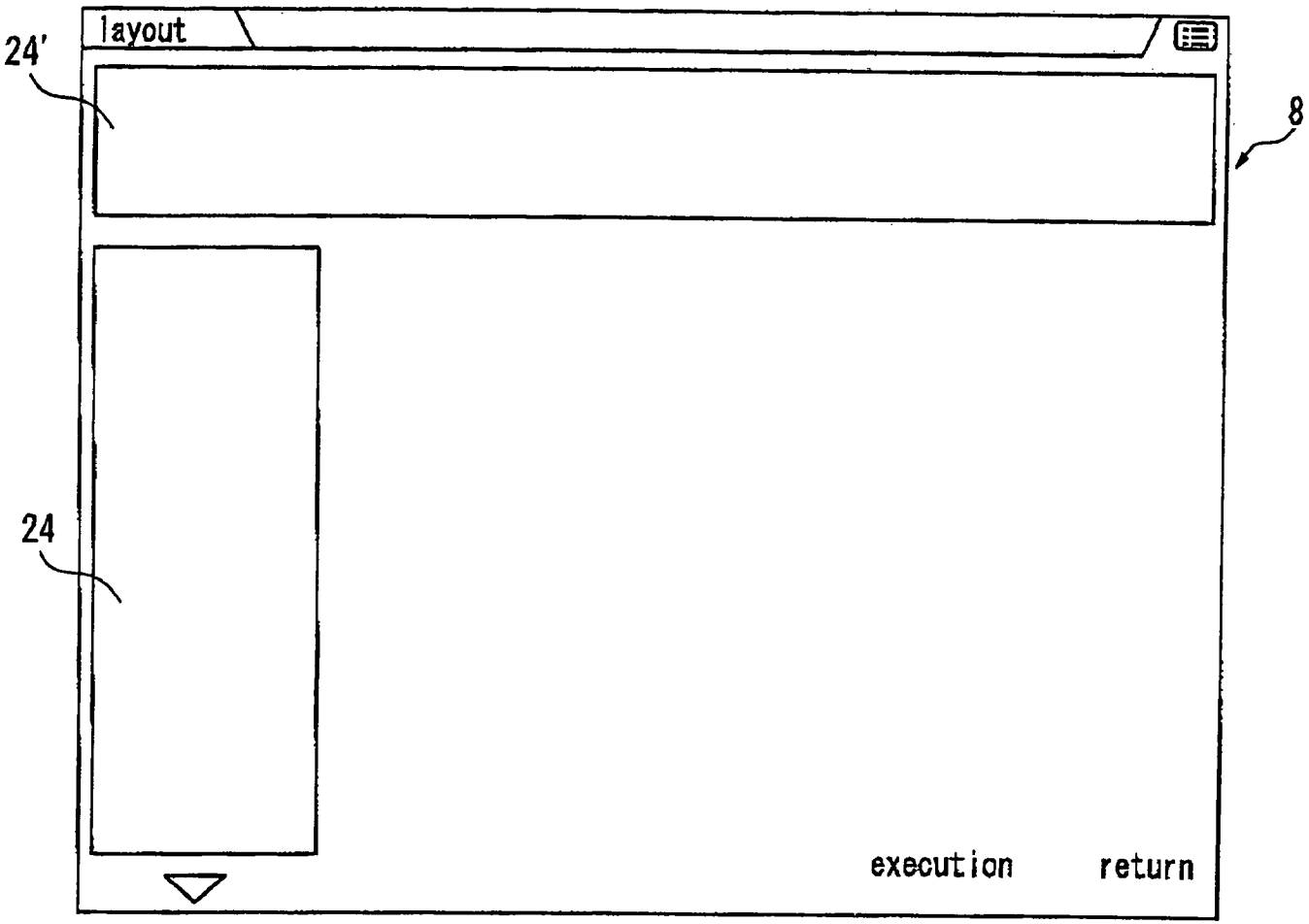
FIG. 17 is a view showing a screen displayed when selecting an initial value of the special chamfering in a selecting menu screen.
Figure 18:
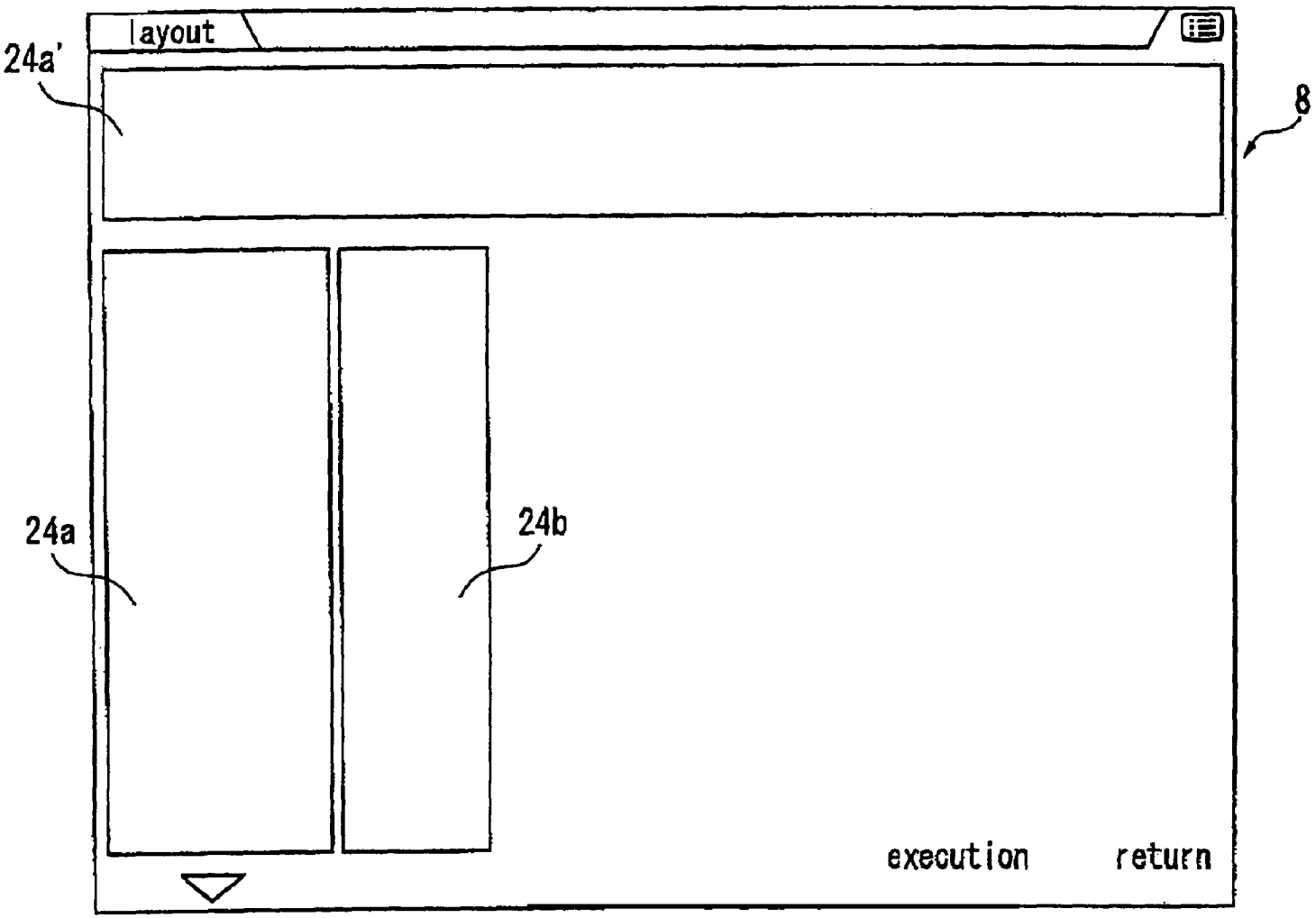
FIG. 18 is a view showing a screen displayed when selecting width of chamfer (front surface, others) in the screen shown in FIG. 17.

When selecting the "initial value of special chamfering" from the selecting menu 23 by the F3, as shown in FIG. 17, messages 24' of "setting, initial value of special chamfering" and "please select items" and a selecting menu 24 are displayed on the liquid crystal indicator 8. At the time, selecting menus of "chamfering width (front side, others)", "chamfering width (ear side)", "chamfering range (ear side)", "chamfering width (nose side)", "chamfering range (nose side)" and so on are displayed on the selecting menu 24. For example, when selecting the "chamfering width (front side, others)" in the selecting menu 24, as shown in FIG. 19, messages 24*a*' of "setting, initial value of special chamfering", "please select items and input numeric values by ±/", "the setting range is 0.1 mm to 1.0 mm" and selecting menus 24*a* and 24*b* are displayed on the liquid crystal indicator 8. At this time, selecting items of "chamfering (front surface) mm", "chamfering (others) mm", and so on are displayed on the selecting menu 24*a* Moreover, selecting items of "1.0", "0.3" and so on are displayed on the selecting menu 24*b* as a range of setting of unit (mm). Meanwhile, the unit is not limited to the setting range and a magnitude of any unit (mm) can be added as an item of the setting range.

Moreover, for example, in a screen of setting the initial value of the special chamfering as shown in FIG. 17, when selecting the "chamfering (ear side)", as shown in FIG. 19, messages 24*c*' of "setting, initial value of special chamfering", "please select items and input numeric values by ±/", "the setting range is chamfering width (0.1 mm to 1.0 mm), range (10 to 90%)" and selecting menus 24*c* and 24*d* are displayed on the liquid crystal indicator 8. At that time, selecting items for selecting materials of the eyeglass lens of "pla", "high pla", "plyca", "acryl" and so on the selecting menu 24*c*. Selecting items of "2.0", "2.0", "2.0", "2.0" and so on the selecting menu 24*d*, as a range of setting of unit (mm), it is possible to set the chamfering width of the edge end of the ear side of the eyeglass lens to 2.0 mm, for example. Here, the "pla" means a plastic lens, "high pla" means a high refractive plastic lens, "polyca" means polycarbonate, "acryl" means an acryl resin.

Figure 20:
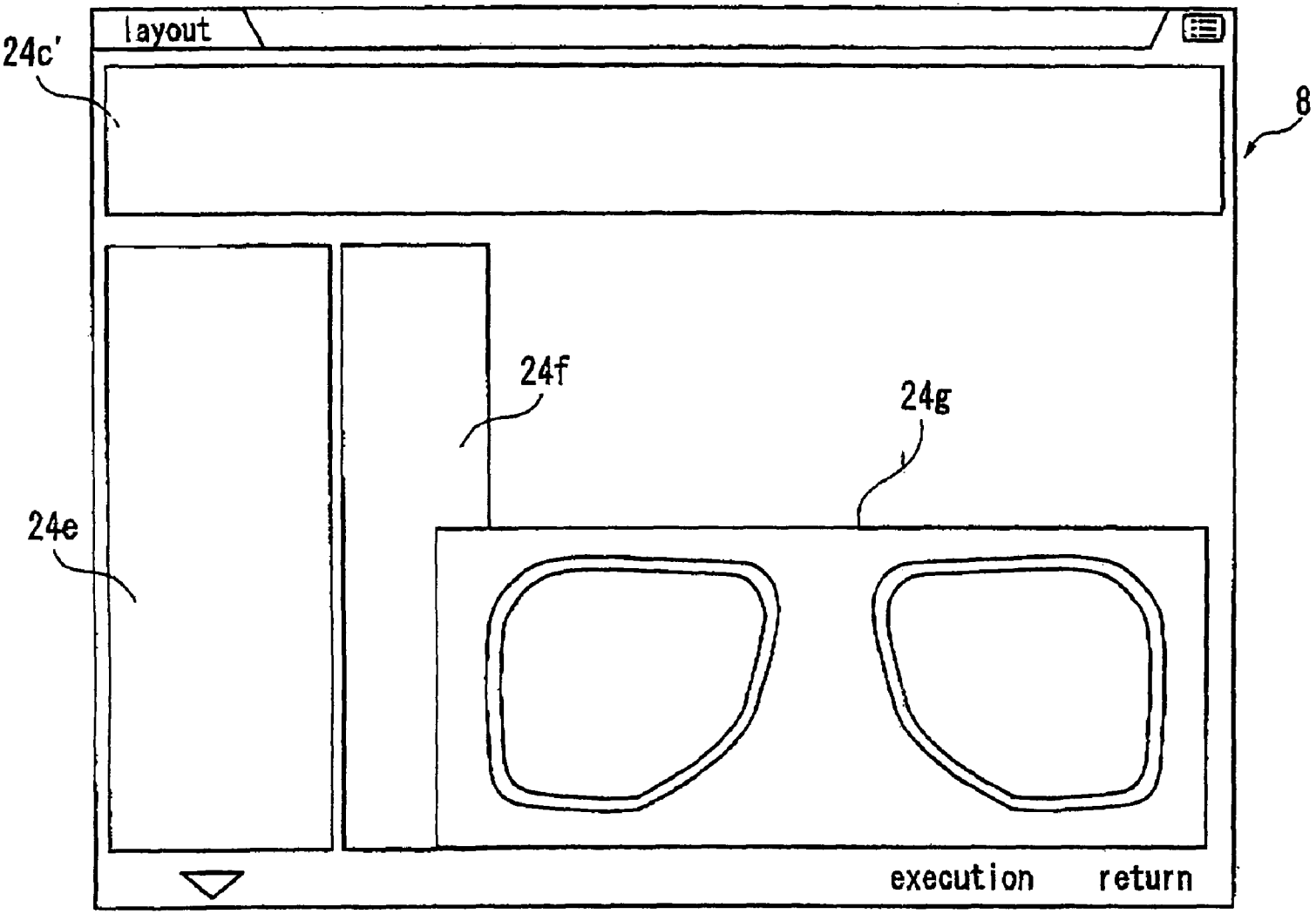
FIG. 20 is a view showing a screen displayed when selecting "width of chamfering (ear side)" in the screen shown in FIG. 17.

Furthermore, for example, in the screen of setting the initial value of the special chamfering as shown in FIG. 17, when selecting the "chamfering range (ear side)", as shown in FIG. 20, the messages 24*c*' of "setting, initial value of special chamfering", "please select items and input numeric values by ±/", "the setting range is chamfering widths (0.1 mm to 5.0 mm), ranges (10 to 90%)", selecting menus 24*e* and 24*f*, and a preview screen 24*g* capable of checking the appearance of chamfering (especially, the chamfering of the edge end of the ear side), when the eyeglass lenses for the right and left eyes are disposed laterally as they are viewed from front, after the processing of chamfer, are displayed on the liquid crystal indicator 8. At this time, the selecting items for selecting materials of the eyeglass lens of the "pla", "high pla", "polyca", "acryl" and so on are displayed on the selecting menu 24*e*. Selecting items of "80", "80", "80", "80" and so on are displayed on the selecting menu 24*f* as a range of setting unit (%) of the chamfering range of the edge end of the ear side of the eyeglass lens.

Then, when selecting "execution" by pressing the functional key F5, the aforementioned setting is completed and the screen of setting the layout is shown, as shown in FIG. 9.

Figure 10:
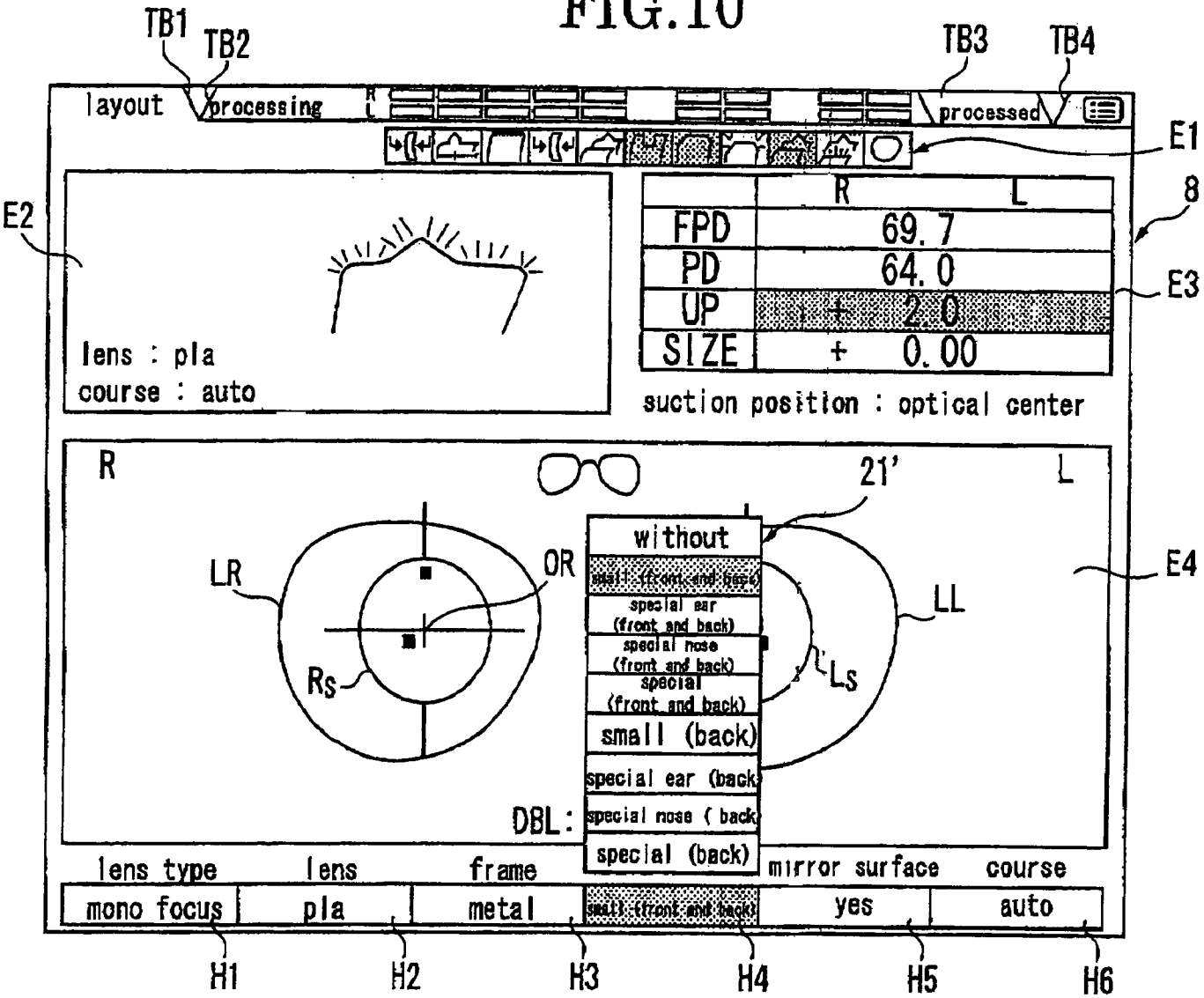
FIG. 10 is an explanatory view showing another displaying example of the popup menu shown in FIG. 8.

Although the initial setting of the "special" for the special chamfering as described above can be carried by pressing the "menu" tab TB4 or "screen" switch 7*a*, the setting for the special chamfering may be carried out by pressing the functional key F4 corresponding to the functional displaying portion H4 in the layout screen as shown in FIG. 10, and by being selected from the popup menu 21', as shown in FIG. 10. In this case, selecting contents of the chamfering positions of "without", "small" (front and back)", "special", "ears (front and back)", "special", "nose (front and back)", "special (front and back)", "small (back)", "special", "ears (back)", "special", "nose (back)", "special (back)" and so on are displayed on the popup menu 21'. In the displaying state, a color of each of the chamfering positions "without", "small" (front and back)", "special", "ears (front and back)", "special", "nose (front and back)", "special (front and back)", "small (back)", "special", "ears (back)", "special", "nose (back)", "special (back)" and so on is inversely displayed. The inversed displayed content is a chamfering position and displayed on the functional displaying portion H4. In FIG. 10, the "small (front and back)" is displayed as a chamfering position.

As described above, it is possible to realize the chamfering processing of a good appearance that the wearer of the eyeglasses likes, without changing the setting values in the middle of processes of "layout setting"→"simulation of chamfer processing"→"chamfering processing", which are normal workings of the chamfering processing, following to the change of the initial setting of the "special" of the special chamfering, and for example, without the edge surface of the eyeglass lens being abutted with holding fittings of the nose pad. Moreover, it is possible to realize the now how of the technical chamfering processing technology that the worker in the eyeglass processing has carried out by hands and to execute the chamfering processing of the eyeglasses finely.

What is claimed is:

1. A method for processing a chamfering of an eyeglass lens, comprising the steps of:

preparing an eyeglass lens having an anterior refracting surface and a posterior refracting surface;

inputting a width of a chamfering and a range of the chamfering from a periphery of a lens shape of the eyeglass lens to form a groove in an edge surface of the eyeglass lens or a V-shaped portion on the edge surface and a front edge portion on the edge surface at one side of the groove or V-shaped portion disposed adjacent to the anterior refracting surface, and forming a back edge portion on the edge surface at a second side of the groove or V-shaped portion disposed adjacent to the posterior refracting surface;

displaying a special chamfering positional mark showing a position of the lens shape, a chamfering positional mark showing a most thinning position of an edge thickness and a chamfering width, a sectional shape at the chamfering positional mark of the lens shape, an edge sectional shape at the special chamfering positional mark of the lens shape to carry out a simulation processing of the eyeglass lens based on input matters, and a state of a chamfering portion and a change in the state of the chamfering portion when the special chamfering positional mark is moved toward the chamfering positional mark in the simulation; and controlling the chamfering of the posterior refracting surface so that a width of the back edge portion in a thickness direction of the eyeglass lens is larger than a width of the front edge portion.

2. The method according to claim 1, wherein the posterior refracting surface is chamfered so that the width of the back edge portion in the thickness direction of the eyeglass lens is larger than the width of the front edge portion by a proportion of 1.2 to 1.

3. The method according to claim 1, wherein the width of the front edge portion is 1.3 mm, and the posterior refracting surface is chamfered so that the width of the back edge portion in the thickness direction of the eyeglass lens is 1.6 mm.

* * * * *